United States Patent [19]

Floyd et al.

[11] 4,442,823

[45] Apr. 17, 1984

[54] BALL THROWING MACHINE AND SYSTEM HAVING THREE INDIVIDUALLY CONTROLLABLE WHEEL SPEEDS AND ANGLES

[75] Inventors: Johnnie E. Floyd, 2609 East Side Dr., Austin, Tex. 78704; Robert A. Brune, Jr., Austin, Tex.

[73] Assignee: Johnnie E. Floyd, Austin, Tex.

[21] Appl. No.: 356,037

[22] Filed: Mar. 8, 1982

[51] Int. Cl.[3] ..... F14B 15/00

[52] U.S. Cl. ..... 124/78; 273/26 D; 124/41 R

[58] Field of Search ..... 124/77, 78–82, 124/41 R; 273/26 R, 26 D, 185 B; 434/247

[56] References Cited

U.S. PATENT DOCUMENTS

| | | | |
|---|---|---|---|
| 1,825,882 | 10/1931 | Mauney | 273/26 D |
| 2,737,941 | 12/1952 | Carrau | 124/78 |
| 3,777,734 | 12/1973 | Holloway et al. | 124/78 |
| 3,807,379 | 4/1974 | Vodinh | 273/26 D |
| 3,838,676 | 10/1974 | Kahelin | 124/81 |
| 3,917,265 | 11/1975 | Schrier et al. | 124/82 |
| 4,026,261 | 5/1977 | Paulson et al. | 124/82 |
| 4,160,942 | 7/1979 | Lynch et al. | 434/252 |
| 4,197,827 | 4/1980 | Smith | 124/78 |
| 4,269,163 | 5/1981 | Feith | 124/77 |
| 4,325,351 | 4/1982 | Yuasa | 127/78 |

*Primary Examiner*—Richard C. Pinkham
*Assistant Examiner*—MaryAnn Stoll
*Attorney, Agent, or Firm*—Wofford, Fails & Zobal

[57] ABSTRACT

A pitching machine and control system which will pitch any baseball pitch desired on command with all parameters of each pitch chosen before the pitch of the ball. The system measures and counteracts the effects of the prevailing weather upon the ball then delivers the ball to the chosen point in the target zone. The parameters of the pitch are: orientation of the seams of the ball with respect to the access of spin, orientation of the access of spin with respect to the direction of travel, location of the release point with respect to the center of the machine (including both height and width), velocity of the ball, magnitude of the spin of the ball, and initial direction of the ball. The target parameters which are also selected before pitch are the target location with respect to the release point of the ball. Internal settings of the machine are adjusted to satisfy the pitch, and target parameters and the prevailing weather. Pitch and target parameters can be stored and played back to control the system.

33 Claims, 40 Drawing Figures

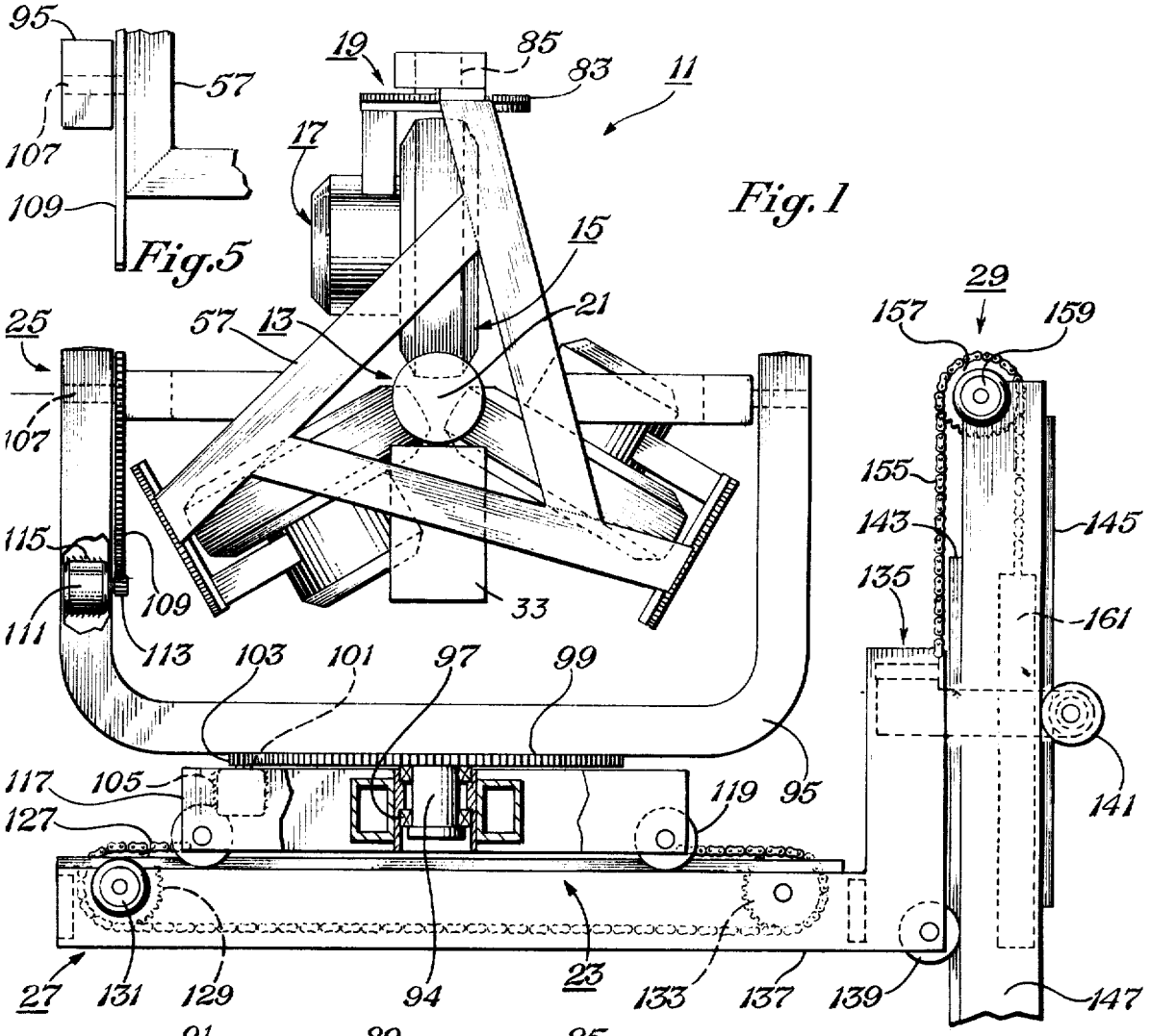
Fig.5
Fig.1
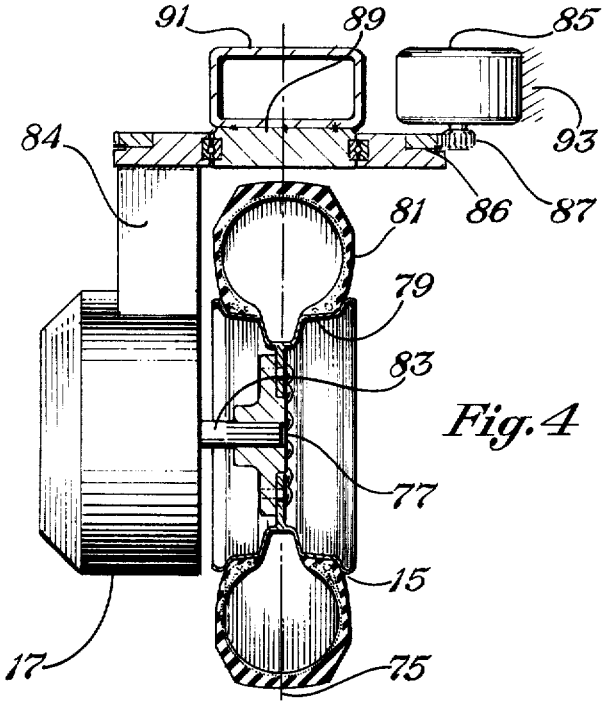
Fig.4
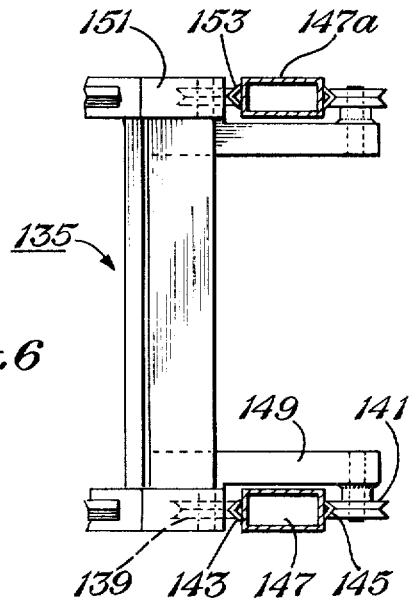
Fig.6 e
85
83

19
85
83
87
17
15
13
35
31
21
109
25
33
11
95
23
103
101
99
129
119
117
121
27
131
123
125

Fig. 7
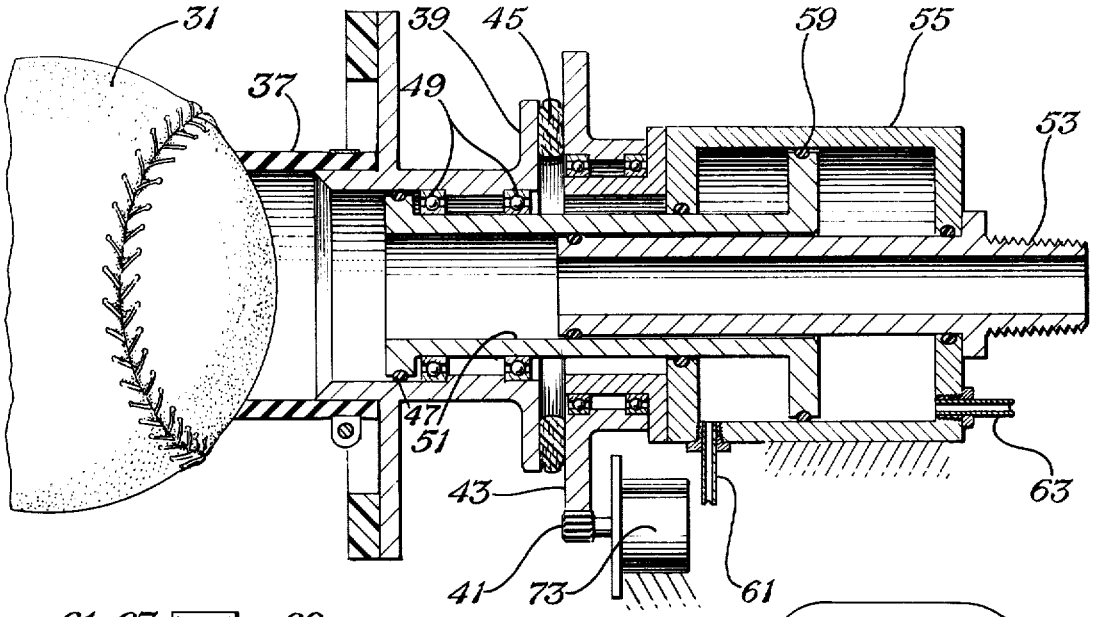
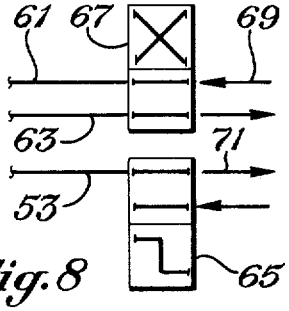
Fig. 8
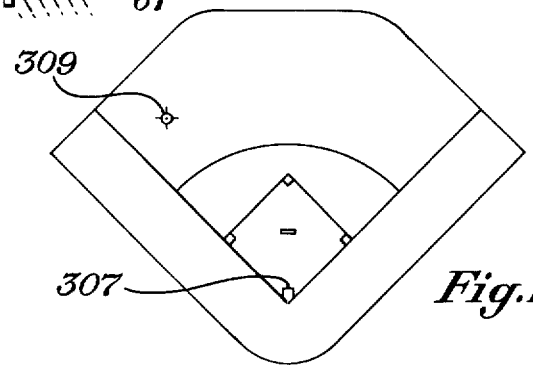
Fig. 17b
| SYMBOL | $V_o$ | $S_m$ | $S_\beta$ | $S_\alpha$ | $X_t$ | $Y_s$ | $Z_s$ | $Y_t$ | $Z_t$ | CHARACTER (PARAMETERS) |
|---|---|---|---|---|---|---|---|---|---|---|
| VALUE | 78 | 4 | 30 | 15 | 60 | +3 | 7 | 1.6 | 2.4 | |
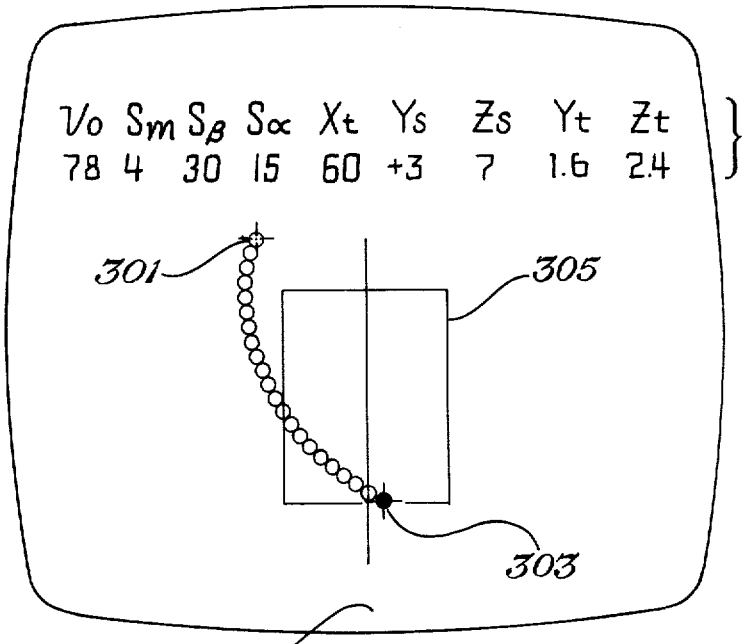
Fig. 17a

CONTROL SYSTEM BLOCK DIAGRAM

-----Mechanically coupled
S Several required
3 3 or more required

MASTER SCHEMATIC

P1

BALL THROWING MACHINE AND SYSTEM HAVING THREE INDIVIDUALLY CONTROLLABLE WHEEL SPEEDS AND ANGLES

BACKGROUND OF THE INVENTION

1. Field of the Invention

This invention relates to a ball pitching machine. More particularly, this invention relates to a machine and integrated machine computer system that can pitch any type of pitched or hit ball; as for practicing batters, infielders, outfielders, tennis players, and the like.

2. Description of the Prior Art

The prior art has seen the development of a wide variety of types of apparatuses for simulating the flight of a ball; as thrown by the human hand, as hit by a baseball bat, tennis racquet or other accessory. From the earliest pitchers in the game of baseball, observers have studied the paths of balls thrown by the human hand, arm, and body. Such observations are steeped in controversy. The physics of ball flight however, requires that the ball leave the hand from an initial position with an initial velocity in a given direction and with a given spin rotation about an axis oriented in space, fly through space acted upon by the medium (air) through which it travels, and be subject to gravity. Some of these variables the pitcher can change from pitch to pitch or maintain the same. It has long been an objective to attempt to duplicate subsets of these variables by mechanical means in order to give batting practice without fatigueing the pitching arms of pitchers and the like. Moreover, it is desirable to give fielding practice with balls along the ground or in the air and combinations thereof to infield and outfield players. A search through the prior art and the marketplace for machines or systems that can mimic the human arm and hand fails to reveal a single complete system that can provide spin about all axes relative to the direction of travel of the ball. The prior art machines have only been able to either (1) pitch a ball spinning with the spin axis in the plane normal to the direction of travel or (2) spin about the direction of travel. No prior art machine could make a change between the two mentioned modes of spin. Most importantly, no prior art machine can place the axis of spin in all the possible orientations with respect to the direction of travel.

Another disadvantage of the prior art machines is that the direction of the flight of the ball was not well defined from pitch to pitch, being strongly a function of the expertise of the operator who operated the machine and intrinsically related to the design of the machine. Moreover, the prior art machines could not orient the seams of the ball; and, thus, the ball in different positions caused erratic performance of the machine in throwing the ball from the output of the ball to the point of impact.

Another disadvantage of the prior art machines is the difficulty of adjusting the machines when initially placing the machines into a service position.

A major disadvantage of the prior art machines has been the lack of ability to predict the flight path of the ball when the pitches are changed, as by changing a variable. The existing machines are primarily employed to pitch the same pitch repeatedly once they are set up to do so. The prior art machines, rather than provide competitive pitching, actually degrade the quality of the practice.

Another disadvantage of the prior art machines is they cannot release the ball from different positions of height and width to simulate right-hand, left-hand, sidearm, or overhead pitching.

From the foregoing it can be seen that the prior art machines failed to provide the following desirable features:

1. The pitching machine should be able to cast a ball to simulate any type of flight of a ball, including but not being limited to thrown balls, batted balls and struck tennis balls.

2. The machine should be able to pitch any curve or spin, including spin about the direction of the flight (called rifle spin) of the ball.

3. The machine should be able to simulate right-hand, left-hand, sidearm, overhead, or underarm delivery.

4. The machine should be able to vary the height of the initial delivery of the ball so that the batter can learn to compensate for such differences in flight of the ball.

5. The machine should be able to vary the altitude angle of the trajectory of the ball for simulating batted balls to infield or outfield practice, as well as pitched balls to the batter.

6. The machine should be able to vary the azimuth angle to compensate for the spin and curve and thereby hit a target area.

SUMMARY OF THE INVENTION

Accordingly, it is an object of this invention to provide one or more of the features delineated hereinbefore and not heretofore provided by the prior art.

It is also an object of this invention to provide a ball pitching machine system that can pitch a ball from various heights and from various widths to simulate right-hand or left-hand delivery, sidearm, overhead, or underarm, in various directions at various speeds and with various spins and speeds of spin with an axis of spin being in any plane; and thereby provide a plurality of the features not heretofore provided.

It is a specific object of this invention to accomplish the foregoing object and to be able to change any one or more of the variables between each and every pitch rapidly in a period of time of a few seconds; to predict and control the flight of the ball and its point of impact at a target any practical distance away; and effect a vertical or horizontal traverse of the ball at any height above or below the height of the machine, the flights not being limited to curves in a vertical or horizontal plane.

Specifically, it is an object of this invention to provide all of the features delineated hereinbefore and not heretofore provided and to simulate to a batter, catcher observer, pitcher or fielder the complete character of the ball in flight as if it were pitched by the human hand but not limited to the human capability, so as to provide an opportunity to bat, catch, observe, train, or exercise without being at the mercy of human weaknesses in pitching or providing flight to a ball and to provide a feedback of the information about the pitch to those interested or being trained; the information being able to provide the input variables for display or for recording before the pitch, as well as after, if it is desired to simulate the pitch in the display.

It is also a specific object of this system to orient the seams of the ball with respect to the spin axis prior to pitching so as to obtain consistent flight characteristics each time the ball is delivered by the system.

These and other objects of this invention will become apparent from the descriptive matter hereinafter, particularly when taken in conjunction with the appended drawings.

In accordance with one aspect of this invention, there is provided a ball pitching machine characterized by:

a. a ball feeding means for feeding respective balls to a feeding point where they will be acted upon by rotating wheels;

b. a plurality of at least three rotatable wheels, the wheels having planes and centers of rotation, the centers of rotation being substantially co-planar and disposed at spaced apart locations in said plane, said wheels and their respective planes of rotation being disposed about said feeding point closely enough to act on a fed ball and adaptable to be oriented at a plurality of rifle angles with respect to a normal trajectory axis equivalent to a straight line of flight of the ball; the wheels having respective location lines from the feeding point to their respective centers of rotation; the location lines being at respective predetermined angles with respect to adjacent location lines and being disposed so as to define a unique feeding point for the ball and to contact the ball at three peripheral points;

c. rotation means for rotating respective said wheels at a plurality of respective rotational speeds for acting on a fed ball and effecting a type of pitched ball; and d. rifle angle means for orienting the planes of the wheels at a plurality of respective rifle angles with respect to the normal trajectory axis and effecting a rifle spin on the pitched ball; whereby the ball can be pitched with a spin about any predetermined axis through a combination of the individual rotation means speeds and the individual respective rifle angle means.

In respective embodiments of this aspect of this invention, the machine also includes one or more of the following additional means; in the preferred embodiment including all of the additional means; including:

a. a main azimuth means for effecting a plurality of predetermined trajectory axes at a plurality of azimuth angles projected on a horizontal plane;

b. a main altitude means for effecting a plurality of predetermined trajectory axes at a plurality of altitude angles in a vertical plane;

c. a translating means for effecting a plurality of predetermined lateral positions for the feeding point for pitching right-hand delivery and left-hand delivery; and d. lifting means for effecting a plurality of predetermined vertical positions for the feeding points for attaining heights of pitching delivery.

Herein the term "pitch" is used in its broad sense connoting any ball delivery, or trajectory, whether simulating a thrown ball or a hit ball. Specifically, it includes a thrown ball simulating a thrown ball that a human pitcher can deliver, with all of its curves and variations; a batted ball as hit by a baseball batter; or a hit ball as hit by a tennis racquet, or various other forms of thrown or hit balls.

In another aspect of this invention, there is provided a system in which there is provided a ball pitching machine described in the first aspect; and interconnected additional elements comprising:

a. a computer means for computing at least the individual speeds of rotation of the respective wheels and individual rifle angles for orienting the wheels;

b. input means for inputting at least one of the sets of the variables that determine impact point and type of pitch;

c. speed control means for bringing respective wheels to their respective speed as computed by the computer means;

d. rifle angle control means for bringing the respective wheels to their respective rifle angles as computed by the computer means; and e. means for energizing the ball feeding means when the desired speeds and rifle angles have been obtained, for feeding the ball to the feeding point for being acted upon by the wheels.

Additional embodiments of this aspect of this invention include the pitching machine that has one or more of the respective azimuth means, altitude means, translating means and lifting means and the computer means has the capability of computing the azimuthal trajectory initially to be given the ball and there is provided azimuth control means for bringing the azimuth angle to the azimuthal trajectory computed by the computer means; the computer means can compute the altitude trajectory initially to be given the ball and there is provided an altitude control means for bringing the altitude angle to the altitude trajectory computed by the computer means; the computer can compute the lateral position from which the ball is to be initially delivered in accordance with the input data and there is provided a translating control means for bringing the lateral position to the lateral position computed by the computer means; the computer means can compute the vertical position for the feeding point of the ball and there is provided a lifting control means for bringing the feeding point to the vertical feeding point computed by the computer means.

In the preferred embodiments, the input variables include the variables for determining the spin and the path of the ball and also the impact point and the respective orienting positions of the pitching machine to effect the desired impact point.

In the preferred embodiment of this invention, there is provided, in addition to the ball magazine for feeding the balls to the pickup point, respective loading and orienting spindles for effecting a predetermined orientation of the seams of the ball for each pitch; and the computer means has an orienting program for effecting the predetermined orienting of the seams of the ball before it is fed into the pitching machine feeding point to be acted upon by the rotating wheels.

BRIEF DESCRIPTION OF THE DRAWINGS

FIG. 1 is a rear elevational view of one embodiment of the ball pitching machine of this invention.

FIG. 4 is a partial cross-sectional view of a rotating wheel with rifle motor offset for clarity of illustration.

FIG. 5 is a partial plan view of the altitude angle shaft and gear.

FIG. 6 is a partial plan view of the lifting assembly of the embodiment of FIG. 1, shown from the underneath side.

FIG. 7 is a partial cross-sectional view of the vacuum operated ball gripper for use in the loading and orienting spindles in accordance with one embodiment of this invention.

FIG. 8 is a schematic illustration of he vacuum system for operating the ball grippers for the loading and orienting spindles.

FIG. 17*a* is a drawing of a video display of parameters, initial, intermediate, and predicted impact points for batting practice. FIG. 17*b* is a drawing of a video display of a plan view of ball diamond with initial and predicted impacts points for fielding practice.

DESCRIPTION OF THE PREFERRED EMBODIMENTS

This invention has wide applicability since it can simulate either a thrown or hit ball. The main uses of this invention, however, may be the duplication of any baseball pitcher's repertoire of pitches. It is in this context, therefore that this invention is described hereinafter. It is believed helpful to describe the capabilities of the pitching machine and its components before introducting the complicating aspects of the computer controls. Accordingly, the first portion of the descriptive material will be describing the pitching machine, per se.

Figures 2, 3:
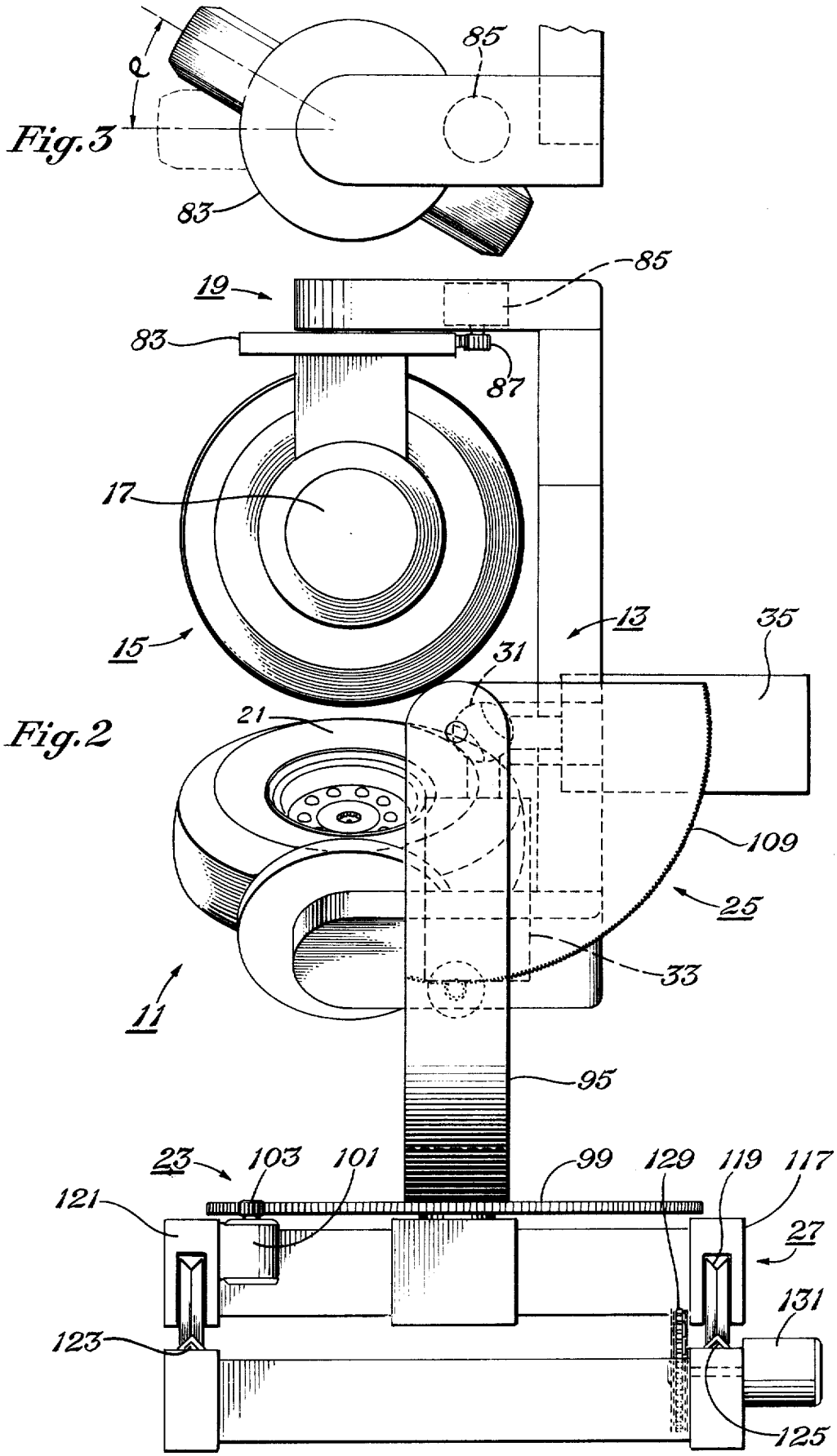
FIG. 2 is a side elevational view of the ball pitching machine of FIG. 1.
FIG. 3 is a partial top view of a rifle motor and encoder of FIG. 2.

Referring to FIGS. 1 and 2, the ball pitching machine 11 includes a ball feeding means 13; a plurality of at least three rotatable wheels 15; respective rotation means 17 for rotating the wheels 15; and rifle angle means 19 for orienting the wheels at a plurality of respective rifle angles with respect to the normal trajectory axis for the pitched ball. The normal trajectory axis is, as defined herein, the imaginary straight line of flight of the ball. As illustrated in FIG. 1 in the usual position, the normal trajectory axis is the axis straight out of the apparatus at the point 21 with no azimuth or altitude corrections.

Preferably, the pitching machine 11 also includes a main azimuth means 23 for effecting a plurality of predetermined trajectory axes at a plurality of azimuths, in a horizontal plane; a main altitude means 25 for effecting a plurality of predetermined trajectory axes at a plurality of altitude angles in a vertical plane; a translating means 27 for effecting a plurality of predetermined lateral positions for the feeding point for simulating right-hand delivery and left-hand delivery; and a lifting means 29 for effecting a plurality of predetermined vertical positions for the feeding points for simulating kinds of pitching delivery such as overhead or sidearm.

Individual subassemblies of the pitching machine 11 will now be described.

The ball feeding means 13 may range from a simple reciprocally movable tweezer arrangement with at least two tines that are off set so as not to be acted upon by the rotating wheels when the ball is fed thereto, to much more complicated apparatus for orienting the ball at a predetermined orientation each time. Basically what is required by the ball feeding means 13 is having a ball at a pickup point and a means for picking up and feeding the ball to the feeding point to be acted upon by the wheels. For example, the ball may be manually placed at the feeding point as by a bat boy. The manual operation without the use of tweezers is somewhat hazardous and is, accordingly, not the preferred mode. The balls may be fed to a pickup point by a tray, a magazine or a combination thereof. The means for picking up and feeding the ball may comprise, in addition to the manual or reciprocally movable tweezers, a loader alone or a combination of a loader and orienter. In the illustrated embodiment, the ball 31, FIG. 2 is fed to the pickup point by a tray extension from a magazine which will be described later hereinafter. At this point it is picked up by an orienter 33 and brought in front of a loader 35 for being pushed forwardly to the feeding point to be acted upon by the rotating wheels.

The loader 35 and the orienter 33 may have very similar structures and may include mechanical structures; such as, the tweezers with the tines offset to avoid interference with the rotating wheels; or fluid operated means for holding the ball. Preferably, and in the illustrated embodiment, the orienter and loader hold the ball with vacuum operated spindles, or tubular shafts, similar to that shown in FIG. 7. As can be seen in FIG. 7, the ball 31 is held against the ball seal 37 by vacuum. The ball 31, seal 37 and clutch 39 move left and right in FIG. 7 for extending and retracting. The stepping motor pinion 41, gear 43, clutch disc 45 and clutch 39 rotate to orient the ball. Seal 47 and bearings 49 enable rotation with respect to the rod 51 without loss of vacuum. The vacuum stem 53 does not move laterally. The outer housing 55 is connected to the triangle frame 57, FIG. 1, and does not move laterally. The rod 51 has internal seals 59 and moves from left to right responsive to air pressure. The air pressure is supplied by way of vents 61, 63. As can be seen in FIG. 8, the vacuum and air pressure can be employed to hold the ball and to extend and retract responsive to respective valves 65, 67. The inlet air pressure in conduit 69 may send air pressure to the inlet 61 to retract the ball whereas when the valve 67 is moved to the other position, it crosses over and supplies air to the vent 63 to extend the ball into the feeding point. Similarly, movement of the valve 65 supplies vacuum from the vacuum conduit 71 to the vacuum stem 53, FIG. 7, for holding the ball. Conversely, movement of the valve 65 otherwise, releases the vacuum and allows the ball to be taken by another spindle. Obviously, when fed into the wheels, the wheels will act on the ball and throw it with much greater force than the vacuum. The air cylinder holds the clutch against the clutch disc while the ball is being oriented. The seal near the ball resists rotation slightly and prevents stray rotation of the ball during the time the ball is being loaded. The motor 73 powering the pinion 41 is also connected with the triangle frame so as to be stationary with respect thereto.

As will be apparent, the orienter spindle may be dispensed within those cases where the ball orientation is not deemed significant enough a factor to bother with. For example, the tray may supply the balls in front of the loader 35 such that the loader can pick up a ball and supply it to the feeding point and retract to allow another ball to be placed in front of the loader. The method of obtaining a predetermined orientation on each ball that is pitched will be described later hereinafter with respect to the computer subroutine for this purpose. All that is necessary for the pitching machine is that the loader feed the balls to the feeding point to be acted upon by the rotating wheels 15.

The three rotating wheels are the very essence of the pitching machine 11. There must be at least three wheels, preferably with somewhat resilient tires thereabout. Less than three wheels is insufficient to define the initial path of the ball. More than three wheels is redundant and contains a confusion of restraints on the ball, although they can be employed as long as they can be oriented about the feeding points so as to act on the ball. The three rotating wheels must be disposed so as to define a unique feeding point for the ball and must contact the ball at three peripheral points. Each of the rotatable wheels, as can be seen in FIG. 4, have respective planes 75 and centers of rotation 77. As illustrated, the wheels comprise a central rotatable hub portion 79 and a tire 81. The centers of rotation of the three wheels are co-planar in a plane substantially parallel with the triangle frame 57, as illustrated, and are disposed at spaced apart locations in the plane. The wheels in their respective planes of rotation are disposed about the feeding point closely enough to act on a fed ball and effect the desired trajectory. The wheels are adaptable to be oriented at a plurality of rifle angles with respect to a normal trajectory axis equivalent to a straight line of flight of the ball. Each of the wheels 15 are illustrated in FIG. 1 with zero degrees rifle angle orientation with respect to the normal trajectory axis 21. In the illustrated embodiment, the respective rotating wheels 15 are equally spaced about the feeding point for the ball 31. While this orientation is the easiest from the mechanical standpoint, as well as from the computational standpoint, it is not absolutely vital. If, however, the wheels are unevenly spaced, the spacing must be accounted for in the computational model that is used as described later hereinafter.

In any event, each of the respective rotating wheels 15 has its hub section 79 affixed by an conventional means to the shaft 83, journalled for rotation by the rotation means 17.

The pitching machine 11 employs a rotation means 17 for each of the rotatable wheels. Each of the rotation means can be varied in speed independently of the others for acting with differential rotational speeds on a fed ball for effecting a type of pitched ball. Expressed otherwise, this means that the different velocities of the peripheral surfaces of the tires 81 of the respective wheels 15 will act on their respective points of contact with the periphery of the ball with respective certain velocity. The circumferential velocity with which the respective three wheels act on the ball serve to impart a type of spin to the ball to effect a curve, or particular type of pitched ball. Obviously, if all of the wheels are rotating at the same speed, all of the forces imparted to the ball will be in the direction of the rotation of the tires, or straight outwardly. For example, if each tire is oriented at zero degrees rifle angle with respect to the normal trajectory axis, the ball will be thrown with the speed as a knuckle ball with no curve.

The rotation means 17 may comprise any of the means for rotating the respective wheels at the desired speeds, which can be varied. Such rotation means may comprise pneumatic motors, hydraulic motors; or, most notably electric motors. As illustrated, the respective rotation means comprise electric motors that can be rotated at different speeds by suitable controls. For example, in the early prototypes, the rotation means comprised D.C. (direct current) motors whose rotational speed were proportional to a setting on a rheostat controlling the amount of current and voltage supplied to the motor. If desired, alternating current (A.C.) motors can be employed with suitable feedback controls to control the rotational speed at a desired speed. Suitable feedback can comprise a tachometer or the like carried by the shaft 83 or otherwise connected with the motor rotating the wheel. Whereas the motor is shown directly driving the shaft 83, it is readily apparent that the motor may be mounted apart from the center line of the shaft and transmit the desired rotational speed by way of belts, chains, or transmissions.

Thus, it can be seen that the respective rotation means allow rotating the respective wheels at individual speeds for effecting one type of curvature of the ball. If the rifle of the ball is desired, respective rifle angle means 19 allow orientating the wheels at different individual angles with respect to the normal trajectory axis for effecting a rifle spin on the pitched balls.

The rifle angle means 19 comprise respective means for orienting the respective wheels at a plurality of respective rifle angles with respect to the normal trajectory axis and effecting a rifle spin on a pitched ball. Any means can be employed that will allow turning the wheel support mechanisms such that the plane of rotation of the wheels makes the desired rifle angle with respect to the normal trajectory axis and holds the desired rifle angle. The computational programs for computers and the like, as well as the ease of subjectively anticipating the effect of the respective angles on the flight characteristics of the ball are made easier if the rifle angle means pivot the wheel about the axis defined by the center of rotation of the wheel into the center of the pitched ball as it is started on its trajectory by being acted on by the wheels. Expressed, otherwise, any distance the axis of pivot is from the defined axis introduces an additional complexity and need for compensating for changing distances and angles. In the FIGS. 1–4, the illustrated rifle angle means comprises a rifle gear 86, a rifle motor, with or without encoder, 85 and a rifle pinion 87. In FIG. 4, the rifle motor is rotated 90° for clarity of showing the relationship between the pinion and the gear on the rifle angle means 19 for the illustrated wheel 15. The central sector 89 is fixedly connected with the stationary portion 91 of the triangular frame 57. The motor 85 is stationarily connected with the frame 57, as shown by the symbol lines 93, such that when it powers the rifle pinion 87, the rifle gear is rotated, rotating the structure carrying the wheel 15. Note in the illustrated embodiment of FIG. 4, the plane 75 and the axis of the wheel 77 passes through the center of the central sector 89 such that the wheel is pivoted about its hereinbefore defined axis. This eliminates having to compensate for moving the wheel off center with respect to the trajectory axis of the ball by rotation of the rifle angle means. Since the rifle pinion 87 engages the rifle gear 86, rotation of the rifle pinion by the motor 85 causes the rotation of the rifle gear to the desired angle. The desired angle may be indicated by angle lines and a pointer on the stationary portion or by suitable electronic encoder and display means.

Since the ball pitching machine having only the three wheels and the rifle angle means has only limited ability to compensate and hit a desired target area with a desired curve on the ball, it is preferred that the machine incorporate at least a main azimuth means 23 and a main altitude means 25 for effecting a desired trajectory.

The main azimuth means 23, FIGS. 1 and 2, comprises any means that will allow the normal trajectory axis of the ball to be aimed at a given angle with respect to the straight ahead position illustrated in FIG. 1. As illustrated, the main azimuth axis means 23 includes an azimuth shaft 94 on the main support frame, or yoke, 95 and journalled for rotation in bearings 97. The main azimuth means 23 also includes the aximuth gear 99, azimuth motor 101 and azimuth pinions 103. The azimuth gear is fixedly connected with the main frame 95, similarly as was the main rifle gear 86 connected to the main support member 84 supporting the respective wheel 15. The azimuth motor 101 powers the shaft mounted pinion 103 to rotate the sector gear and rotate the main U-frame carrying the remainder of the ball pitching machine, including the wheels 15. The azimuth motor 101 is fixed to the translating assembly, indicated by the support marks 105. Consequently, rotation of the motor 101 effects rotation of the azimuth pinion 103, rotating the sector gear forming the azimuth gear 99 and the yoke 95 to obtain the desired azimuth. Similarly as described hereinbefore with respect to the rifle angle means, the azimuth gear 99 may have markings indicating the degrees of azimuth right and left of the straight ahead position or employ suitable encoders to provide an electronic display or electronic feedback on the position of the azimuth gear. Thus, with this main azimuth means 23, an additional latitude, or degree of freedom, is provided for compensating for curves with respect to the vertical axis so as to hit a desired target area. This works well in conjunction with the main altitude means 25 to compensate for curvature with respect to the horizontal plane.

The main altitude means 25 includes an altitude shaft 107, an altitude gear segment 109, altitude motor 111, with or without encoder, and altitude pinion 113. The altitude motor 111 is fixed, as indicated by the symbol 115 with respect to the yoke 95. Consequently, when the motor rotates the altitude pinion 113, the altitude gear segment 109 is rotated causing pivoting of the triangle frame 57 and the carried wheels about the horizontal axis for correcting for curvature with respect to the horizontal axis. As can be seen in FIG. 5, the yoke 95 has journalled therewithin the altitude shaft 107 supporting the triangle frame 57. The altitude gear 109 is fixedly connected with the triangle frame, such that rotation of the altitude gear segment 109 effects the pivoting of the triangle frame 57 about the axis of the altitude shaft 107.

For pitching deliveries, such as right-hand delivery, left-hand delivery, overhead delivery, or sidearm delivery, it is preferred that the pitching machine 11 include a translating means 27 and a lifting means 29.

The translating means 27 may comprise any of the devices for moving the initial starting point of the trajectory of the ball to either the right-hand or left-hand side or any position therebetween. Referring to FIGS. 1 and 2, the translating means incorporates horizontal position assembly 117. The horizontal position assembly 117 is actually a carriage, the points of contact being by way of track-engaging wheels 119 supported in inverted U-frame 121 and engaging rails, or tracks, 123, 125, FIG. 2. Of course, sliding movement along one or more rails can be employed, if desired. The horizontal position assembly 117 thus is actually a carriage carrying the aximuth shaft 93 and the yoke 95 and moveable along the tracks 125 and 123. The horizontal position assembly is pulled longitudinally on the tracks 123 and 125 by way of a chain 127 engaging a sprocket 129 powdered by a motor 131, with or without encoder. Thus the position along the track can be marked off in suitable incremental measures from the center line or an electronic encoder and display can be employed to tell the viewer the position in terms of the horizontal displacement from the center line. The respective tracks may be as long as desired, similarly as may the sprocket 129 be spaced at any desired distance from an idler sprocket 133.

The lifting means 29 may comprise any of the conventional apparatus for raising or lowering the horizontal position assembly carrying the yoke 95. As illustrated, the lifting means comprises the vertical position assembly 135, FIGS. 1 and 6. The vertical position assembly 135 includes main lifting structural carriage 137 having a plurality of wheels 139, 141, engaging oppositely disposed tracks 143, 145 that are affixed, as by welding, to the main vertical beam 147. The carriage 137 includes the member 149 connecting the wheels 139 and 141. At the other end, the lifting structural carriage 137 includes similar structure. If desired, one or more U-members 151 can slidably engage a greased track 153 that is connected with the main structural member **147*a*. To effect the raising and lowering action, a lifting chain 155 is moved by a sprocket 157 that is rotated by a lifting motor 159, with or without gear reducer or a shaft encoder. Thus, when the motor is energized for rotation in a particular direction, the sprocket 157 is rotated. For example, if it is rotated clockwise as it appears in FIG. 1, the left side of the chain is raised, raising the main lifting structural carriage 137 and the yoke 95 carrying the main triangular frame 57. The other end of the chain 155 is connected to a counter weight 161 to facilitate the raising and lowering of the vertical position assembly 135**.

If desired, of course, respective lifting means may comprise a pair of vertical position assemblies 135, one disposed at each end of the vertical position assembly 135. The main vertical beam 147 may be embedded in a concrete foundation or the like. Preferably, it will be on a portable means such as at least a skid such that it can be lifted by a truck or the like and positioned at either home plate, pitchers mound, or in an amusement park. Expressed otherwise, the foundation to which the main structural beam 147 and **147*a*** is connected may be either a permanent or a moveable type structure.

In operation, the pitching machine 11 is placed at a desired location, such as a pitchers mound. The pitching machine 11 is set up such that it will have the target area as the strike zone for a batter. Thereafter, the machine is set up with the desired rifle angles for the rotating wheels and the speeds of the respective wheels are set to obtain the desired curve. A ball is picked up by the loader 35 and fed to the wheels. The rotating wheels act on the ball and cause it to follow a predetermined trajectory toward the batter, catcher or the like. One or more of the speeds of the rotation of the wheel may be altered to change the curve that is given. Simultaneously, the rifle angle means for the respective wheels changed to alter the may be spin given the pitched ball. If the target area is not exactly as desired, the altitude and azimuth of the machine may be altered to a new degree setting to get a new portion of the target being hit. For example, if it is desired to give the batter practice swinging at low balls, the target area may be put in the lower portion of the batters strike zone. Of course, the target of pitched balls may be outside the strike zone if it is desired to check the batter's judgment of such pitched balls.

Conversely, if it is desired to cast fly balls to the outfield, the pitching machine 11 may be placed at home plate and the altitude adjustments made with appropriate azimuth adjustments to get it to right or left or center field. Any desired curvature may be employed on the ball to simulate the different types of batted balls.

Similarly, the machine may be placed on one end of a tennis court to simulate hit tennis balls with the desired top spin, slices, or the like.

In the more elaborate and more easily employed embodiment, the apparatus for throwing the ball includes a control system for automated control of the respective elements and sub-systems. In this way, the total system can operate automatically in response to either a coin operated input, as in an amusement park; a coach type input, as for a baseball team or the like; or a remotely operably console.

Figure 10:
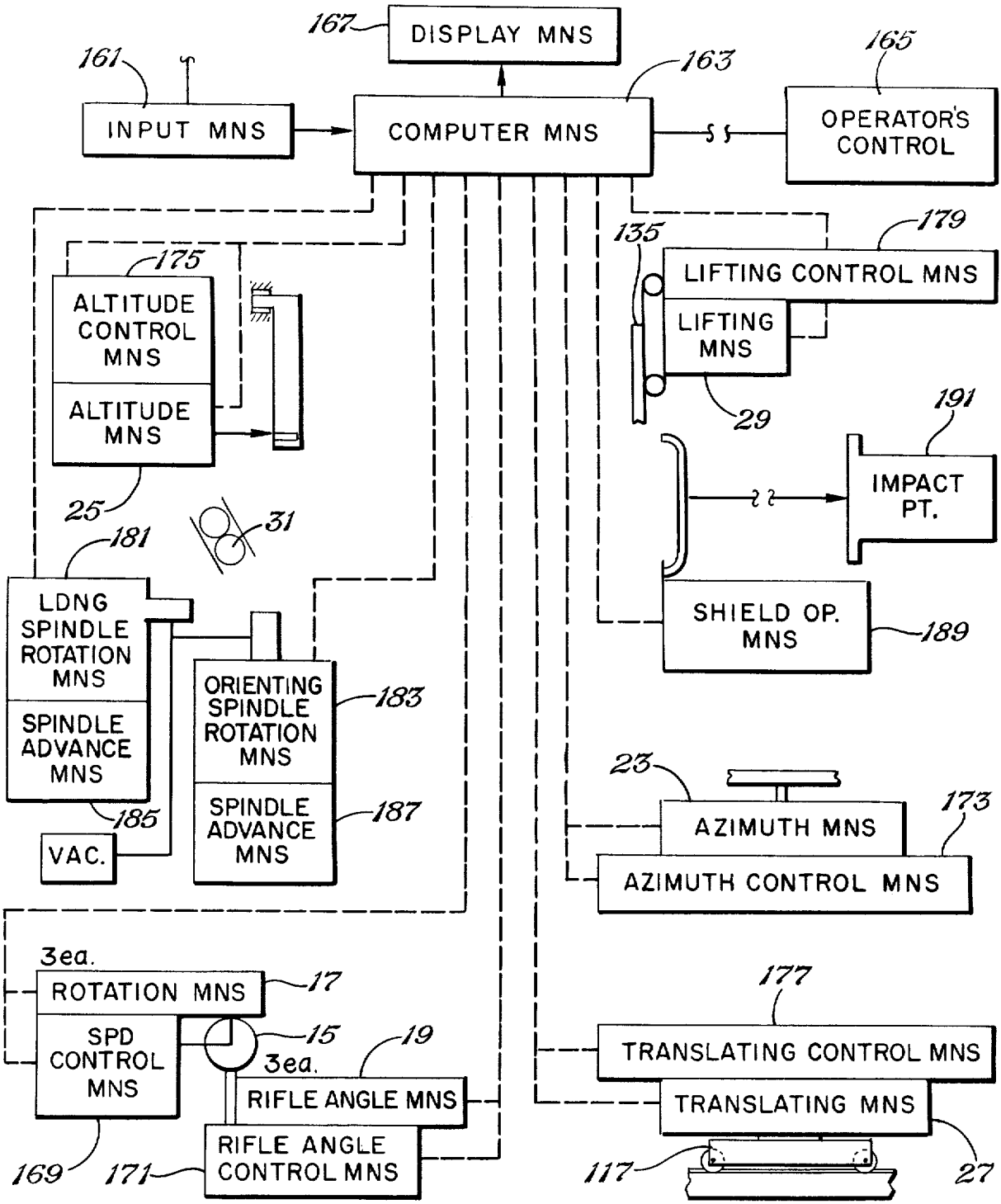
FIG. 10 is a master schematic showing the overall system.

FIG. 10 illustrates one of the preferred additional embodiments set forth hereinbefore. Therein, the input means 161 allows input to the computer means 163. The term "computer means" is used synonymously with the term "controller" herein. It is recognized that a controller may involve servos and the like but herein the computer automates and delivers control signals to the other sub-assemblies and thus serves as a master controller. If desired, the input means 161 may include a remotely operable operators control 165. A display means 167 is employed to allow queries from the computer means 163 as to the variables desired and to display the variables that have been input by way of the input means 161 to ensure that correct understanding is being had by the computer 163.

The computer means 163 then computes the rotational speed for each of the three wheel means and sends the computed rotational speed to the speed control means 169 and the rotation means 17. Consequently, the wheels 15 are brought to speed.

The computer means 163 computes the rifle angle desired for each of the respective wheels 15 and sends the information to the rifle angle control means 171 and the rifle angle means 19. Consequently, the correct rifle angles is imparted to each of the wheel mountings.

The computer means 163 calculates the azimuth desired to obtain a target area designated by the input means 161. The desired azimuth is sent to the azimuth control means 173 and the azimuth means 23. Consequently, the yoke is oriented to have the desired initial computed azimuthal trajectory.

The computer means 163 calculates the altitude trajectory desired. The computer means 163 sends the information to the altitude control means 175 and the altitude means 25. Consequently, the triangle frame is pivoted until the desired initial altitude trajectory is obtained.

The computer means 163 calculates the point from which delivery is to be made in terms of the lateral displacement, or translation; and sends this information to the translating control means 177 and the translating means 27. Consequently, the main carriage, or horizontal positioning assembly 117 is moved to the correct lateral point.

The computer means 163 computes the vertical height from which delivery is to be made and sends the information to the lifting control means 179 and the lifting means 29. Consequently, the vertical position assembly 135 is positioned at the correct height desired.

The computer means 163 enters into the subroutine orienting the balls 31 and sends the respective signals to the loaders and orienters, or respective loading spindle rotation means 181 and orienting spindle rotation means 183. At appropriate points, the computer means 163 signals the spindle advance means 185 and 187 to make the necessary advancing of the spindles to allow exchange from the loader to the orienter to obtain the necessary orientation before the loading spindle feeds the ball into the feeding point.

Just before the ball is fed to the feeding point, the computer means 163 signals the shield opening means 189 to open the shield for a time sufficient to allow the ball to be pitched; and then to close the shield before a ball can be batted back at the system. In this interim, the computer 163 will have signalled the loading spindle to have fed the ball to the feeding point to be acted upon by the rotating wheels 15 such that the ball arrives at the impact point 191.

Figure 9:
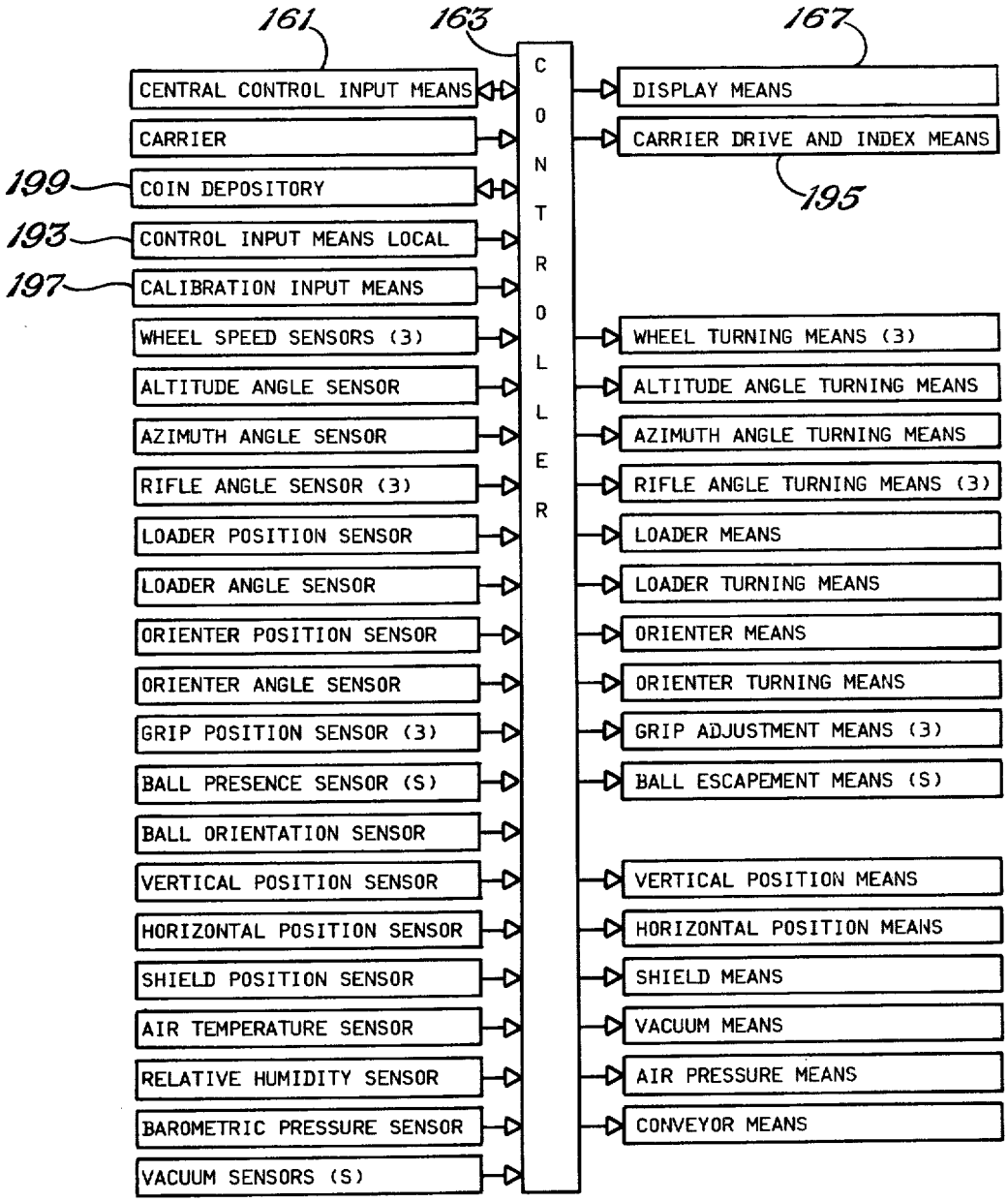
FIG. 9 is a block diagram of the control system in accordance with another embodiment of this invention.

FIG. 9 illustrates a control system block diagram for a coin operated system, such as would be employed at an amusement park or the like.

The central control input means (CCIM) 161 performs several functions and is able to communicate with the controller, or computer means, 163. The input means 161 records the character of several pitches sequentially onto a carrier (magnetic card or the like). The carrier is then physically taken to the local control input means (LCIM) 193 and inserted into the carrier drive and index means 195 such that a game of several pitches is transferred to the controllers internal memory.

The calibration input means 197 data is used by the computer 163 to make corrections to the calculated motor position and speed values. Its output goes to the computer 163 and ultimately to the central control. The calibration data thus collected and processed compensates for the instumental errors. Similar calibration for machine errors can be employed as desired.

The carrier drive and index means 195 indexes and reads the carrier, thus assisting in transferring to the memory of the computer 163, the sequence of pitches, or game. The carrier drive and index means 195 also signals the machine that it will be controlled by the local controller input means 193. Typically a card reader would be an example of this local control input means 193 where a magnetic card is employed as the carrier. If desired, of course, tapes in the form of cartridges or the like may be employed as the carrier and the local control input means 193 may be a tape player with record and play heads to fulfill this function in this system.

A coin depository 199 is employed to accept coins, give change, and signal the computer 163 that the machine will be controlled by the local control input means 193.

The display means 167 is a projection screen, FIG. 17A, such as a cathode ray tube, whose information is provided by the controller 163. The display has two types of information to display. First, it displays the questions, or queries, in pictures, letters and numbers that elicit an input response; for example, from the local control input means 193. Secondly, it displays, after receipt and processing of the inputs, the character and the trajectory of the pitch that will occur.

The local control input means 193 has, in addition to the carrier read capability, a two dimensional array of switches in one-to-one correspondence with the display such that the respective queries can be answered with an input by an operator. If desired, for example, the query for the particular variable may be displayed on a cathode ray tube and answered by a light pencil placed on the input by the operator. On the other hand, of course, the switches can be employed, per se, to afford an input.

Implicit in the software to be described hereinafter is a requirement for a hardware element such as the parameter input boards for providing parameter information; such as, the coins, times, delays and the like.

The remainder of the blocks in the control system block diagram in FIG. 9 are believed self-explanatory and will become clearly apparent from the descriptive matter hereinafter, as well as hereinbefore.

Figure 12:
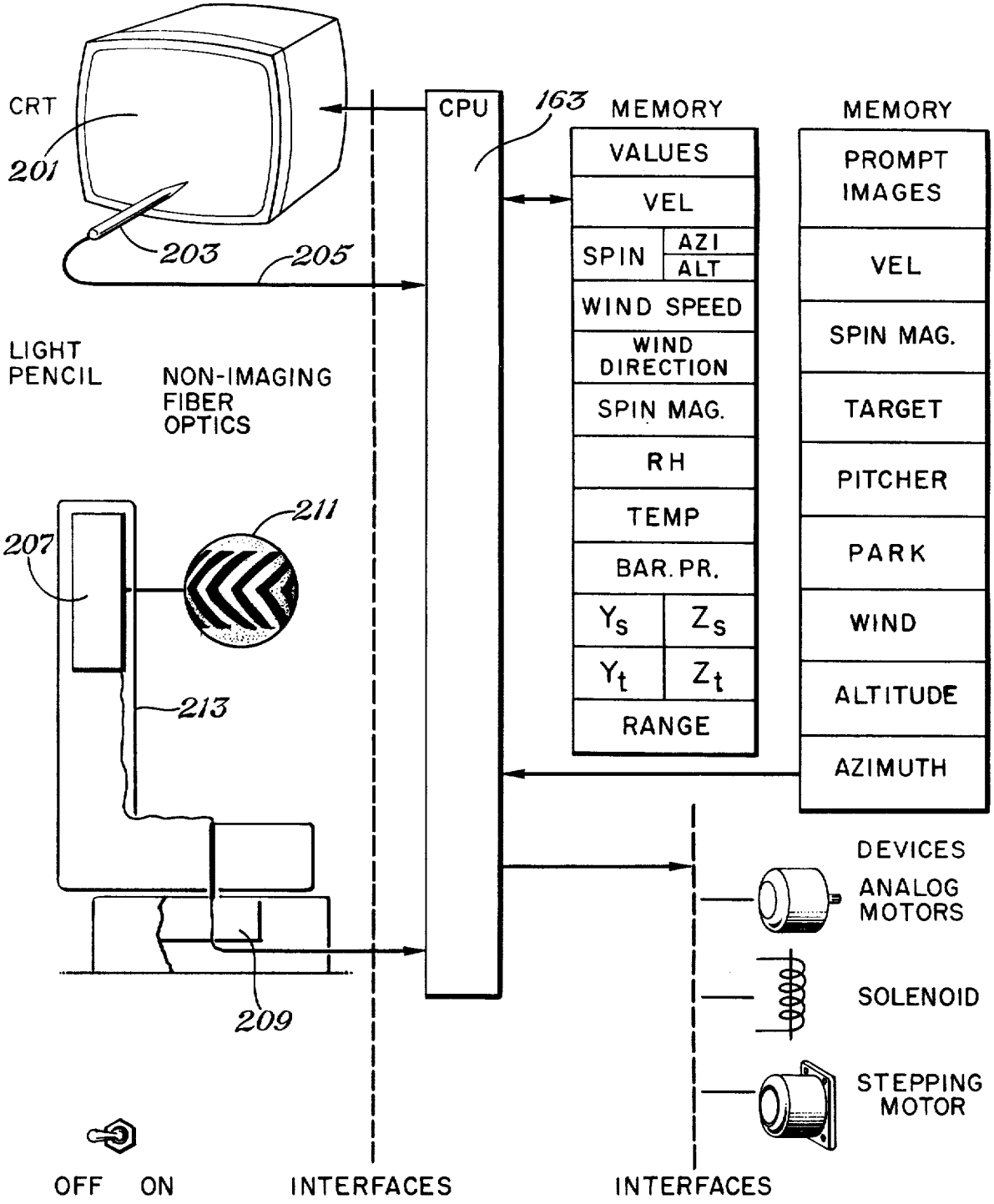
FIG. 12 is a schematic illustration of another embodiment of this invention employing a video display and computer.

Referring to FIG. 12, there is illustrated in somewhat schematic form, a typical input means. Therein, the cathode ray tube 201 is connected with the controller 163 so as to display the queries. A light pencil 203 is also connected, as by fiber optics or the like 205, with the computer so as to input answers to the queries that are displayed. For example, the light pencil can be moved to a number in a grid for indicating the velocity to be given the ball; or to select from among a pattern of selected values for other parameters. Any other method of putting in data can be employed. For example X-Y position sensors, such as matrix switches can be employed.

With respect to the spin query, which may be brought up by the prompt image from memory, the simplest way to input the information is to employ two respective shaft encoder meters 207 and 209 such that the ball knob 211 can be twisted to a setting on the shaft encoder 207 to get the desired spin direction vector around the indicated horizontal axis through the ball. The holder 213 can be rotated to obtain the desired setting on the potentiometer 209 to get the spin direction vector with respect to the vertical axis through the ball. The other inputs, such as wind magnitude and direction, may be input by potentiometer devices (not shown). The range $X_t$, may be put in with a conventional numeric designator such as a keyboard or from an analog display like FIGS. 17*a* and 17*b*. Similarly, the target $Y_t$ and $Z_t$ can be input thusly. The pitches, $Y_s$ and $Z_s$, simulating right-hand and left-hand delivery can be similarly put in with digital or analog indicating information. Information such as the relative humidity, temperature, barometric pressure and the like may be input by digital or analog information or by signals from the instruments giving that information in language compatable with the language accepted by the computer 163.

In the system, there are a variety of interconnect and feedback arrangements to enable the computer to calculate and effect the desired calculated variables. Basically, however, there are three types of such means. They are velocity attaining means, angle attaining means, and position attaining means.

Figure 13:
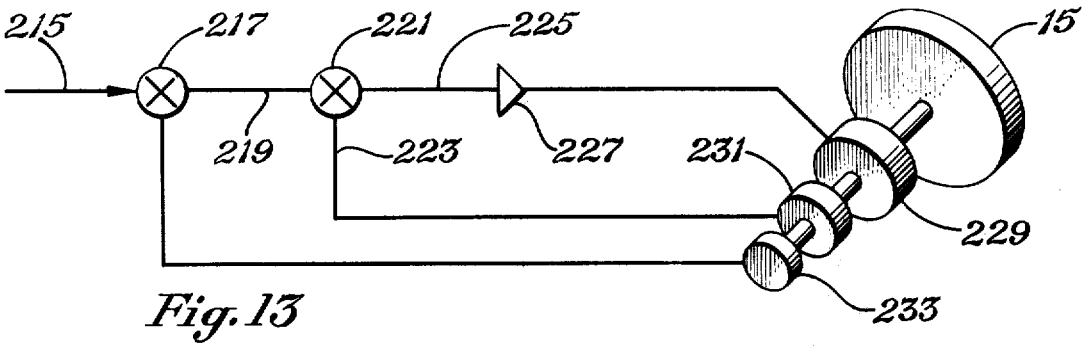
FIG. 13 is a schematic illustration of an interface interconnection between the computer and wheel speed control means.

The main velocity attaining means are the wheel rotation means. The angle position attaining means are the altitude angle attaining means, the azimuth angle attaining means, the rifle angle attaining means, the loader turning means, and the orienter turning means. The position attaining means are the vertical position means, the horizontal position means, the shield means, and the conveyer means. Of these types, the velocity attaining means can be seen in FIG. 13. Basically, the computer output in form of the digital reference will be impressed on conductor 215. A digital comparator and digital-to-analog converter 217 will convert the digital input to an analog voltage output on the conductor 219. Analog comparator 221 compares the difference between the analog voltage and that supplied by the feedback conductor 223. The difference signal is sent by way of conductor 225 to amplifier 227. The motor 229 serving as a rotation means 17, is brought to a desired speed. The speed is sensed by the D.C. (direct current) tachometer 231. When the wheel 15 is brought to the desired speed by the motor 229, the tachometer 231 supplies a correct cancelling voltage via conductor 223 to maintain the motor 229 at the desired speed. A digital tachometer 233 will provide digital position feedback information to the comparator 217. This adds stability to the control and minimizes hunting and variations in speed.

The specific speed required is predetermined for each pitch and for each of the three wheels 15 to obtain the pitch desired, as will be apparent more clearly from the description herein.

Figure 14:
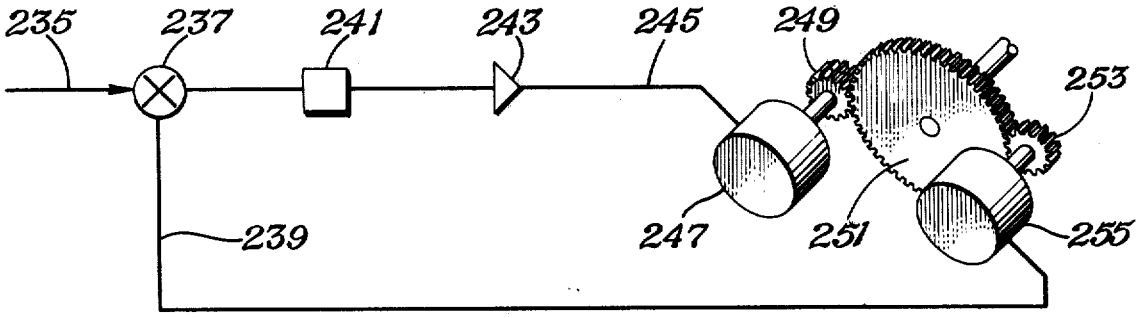
FIG. 14 is a schematic illustration of a typical interface interconnection between the computer and an angle positioning means, such as the rifle angle means.

Of the systems listed hereinbefore, the following systems move a respective part, element, or subsystem of the pitching machine 11 to an initial position in preparation for pitching the ball and before the ball is fed to the feeding point. These subsystems are the altitude angle attaining means, the azimuth angle attaining means, the rifle angle attaining means, the vertical position means, and the horizontal position means. These means bring the ball to the appropriate point and get the machine 11 ready to release the ball from the proper location and along the proper direction with the proper spin. In each of these subsystems, the control problem is one of sending the appropriate number of pulses to a stepper motor such that the element of the subsystem is properly positioned. The control can keep track of where the drive is in either of two ways. One it can remember where the device was and add or subtract the pulses sent to the stepping motor for the element and compute the new position for the device. This is referred to as an open loop. On the other hand, the control can include an encoder in the feedback loop such that the encoder reports just where the element is located. The encoder can be incremental or absolute. If the encoder is incremental, then the encoder pulses must be subtracted from the pulses going to the motor and the controller thereby computes the new position of the element. If the encoder is an absolute encoder, then the control interrogates the encoder and gets directly the position information. The decision to go open loop versus closed loop depends upon the consequences of the types of failure that the system might have or the desire to decrease the sensitivity of the system to perturbations. A typical one of these subsystems is illustrated in FIG. 14. Therein, the required position is signalled on a conductor, such as conductor 235. A comparator 237 compares the signals on conductor 235 and feedback conductor 239. The output of the comparator is connected with the input of the accumulator 241. The output of the accumulator 241 is connected via amplifier 243 and conductors such as 245 with the motor 247 driving the pinion 249. Pinion 249 meshes with the gear 251 so as to rotate the element connected therewith into the desired position. As part of the feedback, a pinion 253 drives the encoder 255 which is connected via the conductor 239 with the comparator 237. Thus in operation, the motor 247 is rotated the desired amount to bring the element connected to the gear 251 into the desired position and that position is fed back by way of the encoder 255 to the comparator 237. Rotation is stopped when the desired position is attained.

As will be appreciated, the respective elements can be turned to any one of a substantially infinite number of angular positions to attain the desired position for the gear, or element.

Figure 15:
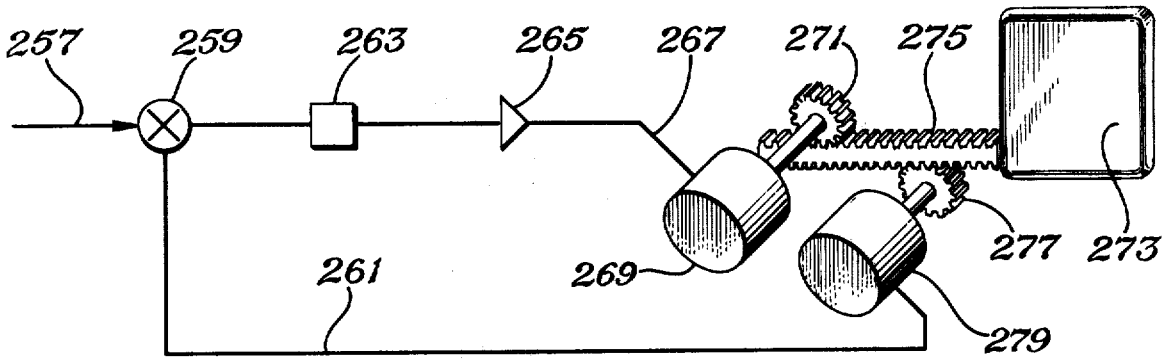
FIG. 15 is a schematic illustration of a typical interface interconnection between the computer and a shield operating mechanism.

Another of the subsystems involves the shield means and the shield opening means 189. This can be seen by referring to FIG. 15. The control need in this subsystem is simple since it is only necessary to open and close the shield in front of the pitching machine; that is, there are only two positions. In FIG. 15, a sensor, or encoder is shown for consistency. It is readily apparent that the sensor could be only a limit switch to allow the controller to make sure the shield was open before pitching the ball. Basically, the open or close signal is sent from the computer on conductor 257. The signal is compared via the comparator 259 with the signal impressed on the feedback conductor 261. The difference is sent to the accumulator 263 and then via amplifier 265 and conductor 267 to effect rotation of the motor 269. The motor 269 rotates the pinion 271. The pinion 271 engages the rack 275 that is connected to the shield 273 so as to move it the desired amount. The rack 275 also engages pinion 277 which is drivingly connected with the encoder 279. The encoder 279 is connected by way of the conductor 261 with the comparator 259.

In operation, the computer signals to open the shield and the motor 269 is rotated to pull the rack to move the shield from in front of the machine for the pitching. When the encoder 279 senses and signals that the shield is open, the comparator 259 stops the signal to the motor and the computer can then effect pitching of the ball. After an elapsed interval of time, as will be described hereinafter, the computer signals to close the shield and protect the pitching machine 11 from a batted ball. Consequently, the comparator 259 sends a signal to reverse the motor and close the shield 273. Reverse rotation of the pinion 277 reverses the position of the encoder 279 and that information is fed back to the comparator. The motor 269 is stopped when the shield is again in place in front of the machine.

The final type subsystem involves the loader and orienter. The respective elements are the loader turning means, the orienter turning means, the loader vacuum valve, the orienter vacuum valve, the loader means, the orienter means, the loader angle sensor, the orienter angle sensor, the loader position sensor, the orienter position sensor, the ball presence sensor, the ball orientation sensor. All these work in concert with the computer 163 and its software as will be described with respect to the program hereinafter.

Figure 16:
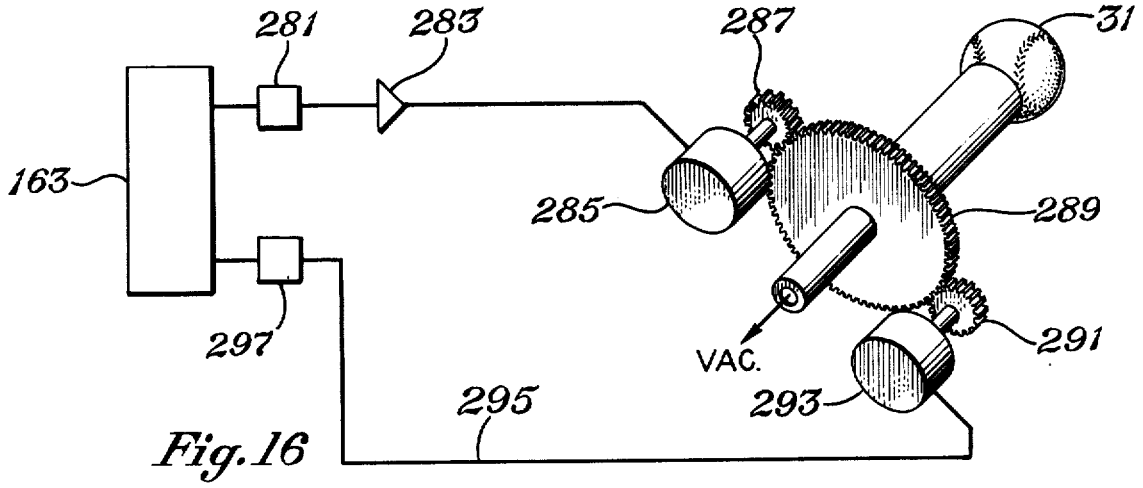
FIG. 16 is a schematic illustration of a typical interface interconnection between the computer and ball orienting tubular shaft.

In the first phase of operation of this system the device is to orient the ball to a common orientation with respect to the ball orientation sensor in the X axis. In the second phase, the ball is orientated by two rotations into an orientation that is related to the upcoming pitch. If desired, the system may employ an open loop with a stepping motor and the controller to register the position of the motor when the ball orientation sensor first sees a seam come under it while the motor continues. When the ball orientation sensor sees a seam next, the position is registered by the controller. The motor is stopped. The controller calculates the midpoint position between the first and second seams. The motor is reversed then stopped at the midpoint position. Preferably, a closed loop system similar to that illustrated in FIG. 16 is employed. The closed loop is like the open loop in that it orients the ball but the controller interrogates an encoder rather than remembering the position of the motor. Referring to FIG. 16, the computer 163 sends the desired rotation signals via the interface interconnection 281 and amplifier 283 that are serially connected with the stepping motor 285. The stepping motor 285 is drivingly connected with the pinion 287 meshingly engaging the gear 289. Consequently, the gear and the connected spindle rotates the ball 31. A meshingly engaged pinion 291 is also rotated, rotating the encoder 293. The encoder 293 is interogated by way of conductor 295 and the interface 297 serially connected with the computer 163.

The loader and orienter systems are identical and operate as described hereinbefore with respect to the open loop system. The ball is transferred at the direction of the software and the computer means 163 at appropriate times in the program, as will be discussed hereinafter.

The display means 167 will display the indicated type of pitch that is desired. For example, the respective variables may be displayed at the top of the screen 299, FIG. 17*a* to ensure that the computer means 163 has correctly understood the responses to its queries. In response to the calculation of the trajectory, as will be described hereinafter, the computer displays an initial starting point 301 and a plurality of intermediate positions to the final impact point 303, as illustrated. If desired, the strike zone 305 can be illustrated also. On the other hand, if the machine is to be employed as a batting practice machine, the machine may be located at a batting location 307, FIG. 17*b* and the point of impact 309 shown to illustrate whether right or left field will be given the practice on that particular "pitch" or simulated batted ball. Also the height of the ball above impact position 309 may be specified digitally or taken from an analog display.

Figure 18:
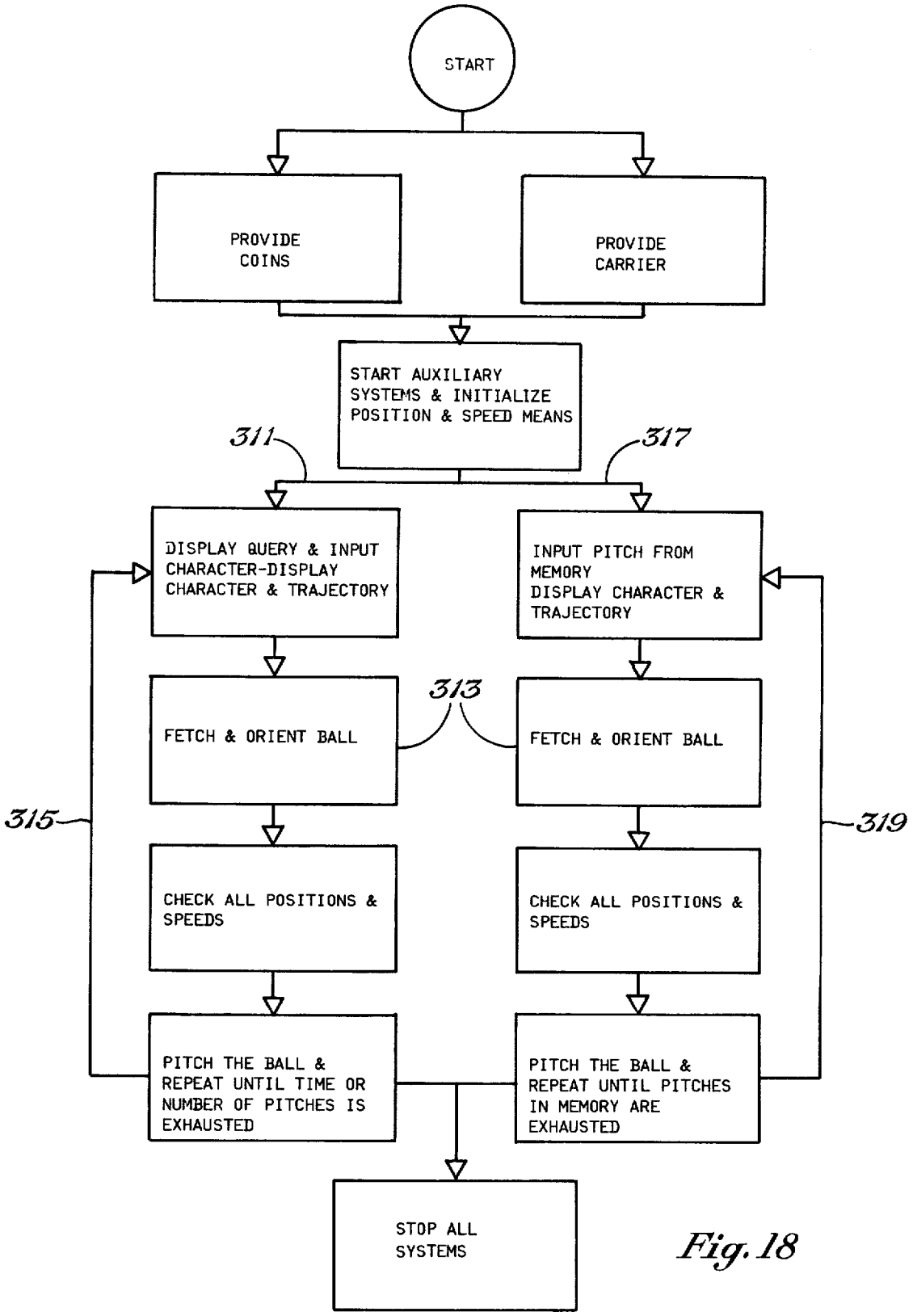
FIG. 18 is a schematic overview of a computer program for a complete system in accordance with an embodiment of this invention.

FIG. 18 illustrates an overall schematic view of the interaction of the pitching machine 11 and the program structure of the software. As can be seen in FIG. 18, the system is started by turning on an appropriate master control. Thereafter, coins are provided if one route is to be taken or a carrier is provided if another route is to be taken. This provision of either coins or a carrier starts the auxiliary systems and initializes, or brings to a starting position, the respective positions and speeds on the devices. Thereafter, going the route 311, the display queries and receives an input on the particular characters, or variables. Once a pitch is agreed upon, the fetch and orient routine 313 brings the ball into position with a predetermined orientation. All positions and speeds are checked and the ball is fed to the feeding point such that it is acted upon by the rotating wheels to pitch the ball. Thereafter, a return is made via route 315 and the cycle repeated until either the time or the number of pitches is exhausted, depending upon the mode in which the system is being operated. Conversely, if the route 317 is employed, the type of pitch and the variables are input from memory. The display may show the character and trajectory similarly as noted before. The fetch and orient ball routine is the same as before. Similarly as before, all positions and speeds are checked. Thereafter, the ball is fed to the feeding point where it is acted upon by the rotating wheels and the pitches are again repeated via route 319 until all of the pitches in memory are exhausted. After the conclusion of either of these routes, as by exhaustion of memory, number of pitches, or time, all systems are stopped.

Figure 19:
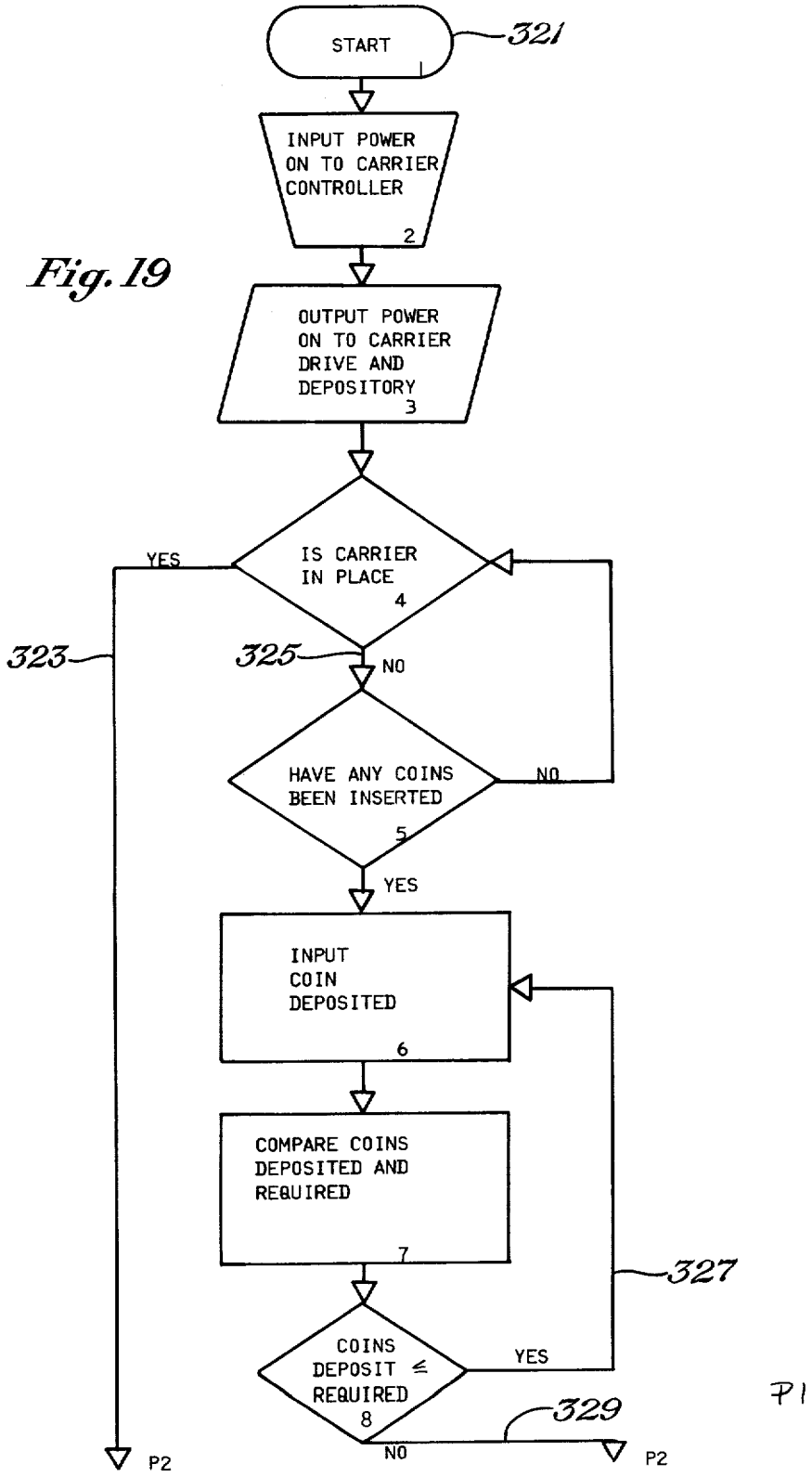
FIGS. 19–27 is a flow diagram of a computer program in accordance with FIG. 18.
Figure 20:
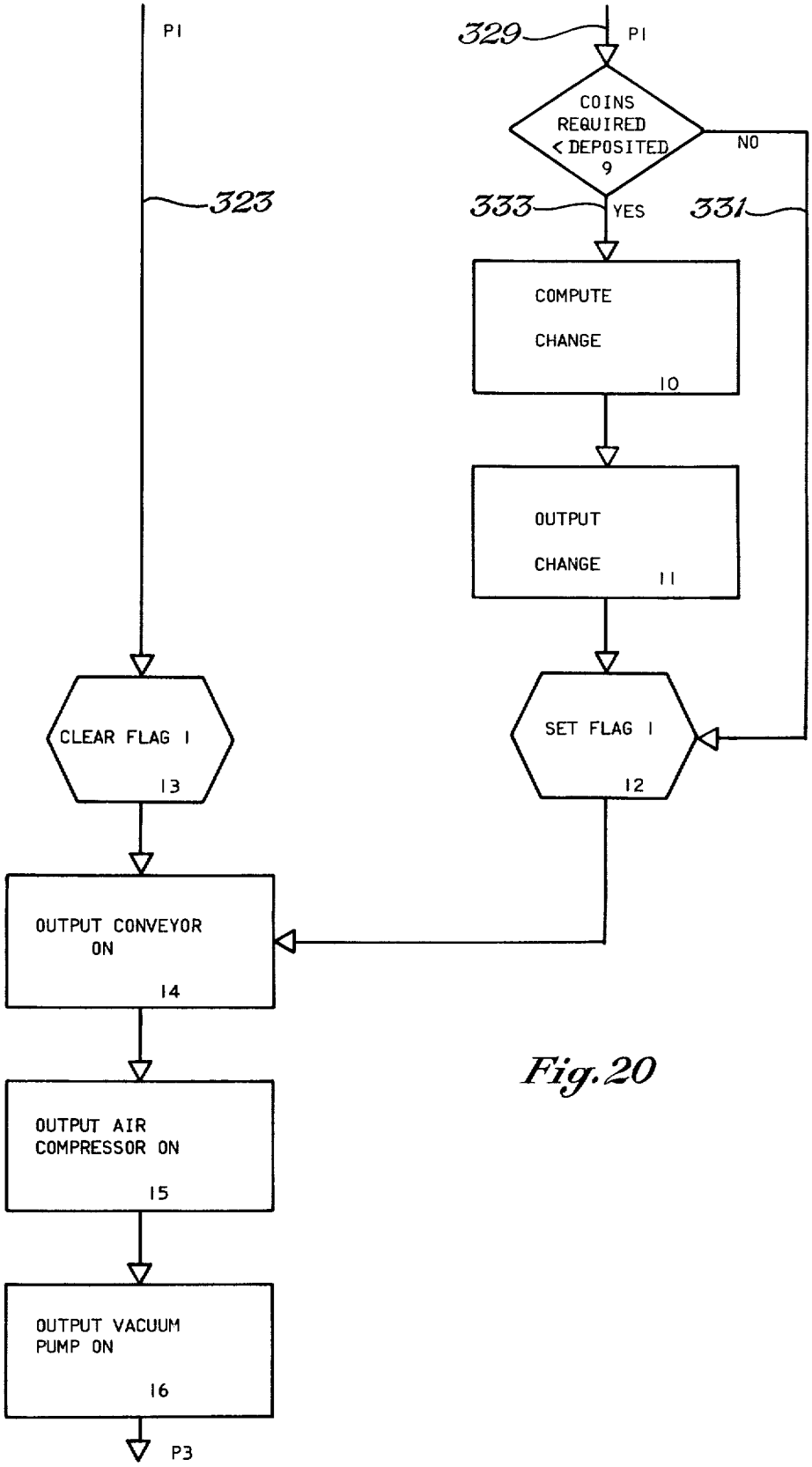

Referring to FIG. 19 et seq., there is illustrated a flow diagram of the software, or the program for operating the computer means 163 and interconnected elements. The system is started, as indicated at 321, or starting block 1. As a consequence, power is input to the controller, or computer means 163, FIG. 10. The computer puts power out onto the carrier drives and the respective depositories. A parameter input panel allows the programmer to fix at any value, the delay times, the value of the coins and the like. First the computer checks to see if a carrier is in place. If a carrier is in place, it takes the yes route 323 as illustrated in FIG. 20, the yes route 323, cleans the flag and sends an output to turn on the conveyor.

If, on the other hand, the carrier were not in place, the computer would go the no route 325 and check if coins had been inserted. If no coins were inserted, the program would return to again query whether or not a carrier were in place. If coins have been inserted, the computer would then check to see if the coin deposits were greater than the coins required. If inadequate coins were deposited, the computer would follow the yes route 327 to return to the coin input block. If the coins deposited is greater than the coins required, the computer would take the no route 329, FIG. 20. The computer then asks is the coins required less than the coins deposited. If no, this is taken as just enough coins so the computer goes the no route 331 and sets the flag that will be used to distinguish which branch of the program is needed later. If the answer to the question is yes, then the computer takes the yes route 333 and computes the change to be given. The output is sent and the correct change is given. Thereafter, the flag is set to distinguish the branch of the program, similarly as done by the no route 331. Thus, in effect, the computer simply checks if the coins have been deposited and if so then the necessary output is sent to turn on the conveyer, turn on the air compressor, turn on the vacuum pump, and position the motors to the desired values; that is, start to bring the system motors up to speed and into known positions at the output position motor values block 335, FIG. 21. In the software program, Figures blocks numbers are employed and designation of P1, P2, P3 and the like refer backward or forward to the respective pages of the drawings assuming FIG. 19 to be the first page.

The theory of operation is that if money is paid in a recreational center, the individual is going to stipulate the variables for controlling every pitch; whereas, if a cassette was emplaced in the machine, the cassette will be paid for and it will describe the order of the pitches for the respective balls. In either event, however, the conveyer must be turned on, the air compressor turned on, the vacuum turned on, and the motors brought to the desired known positions.

Figure 21:
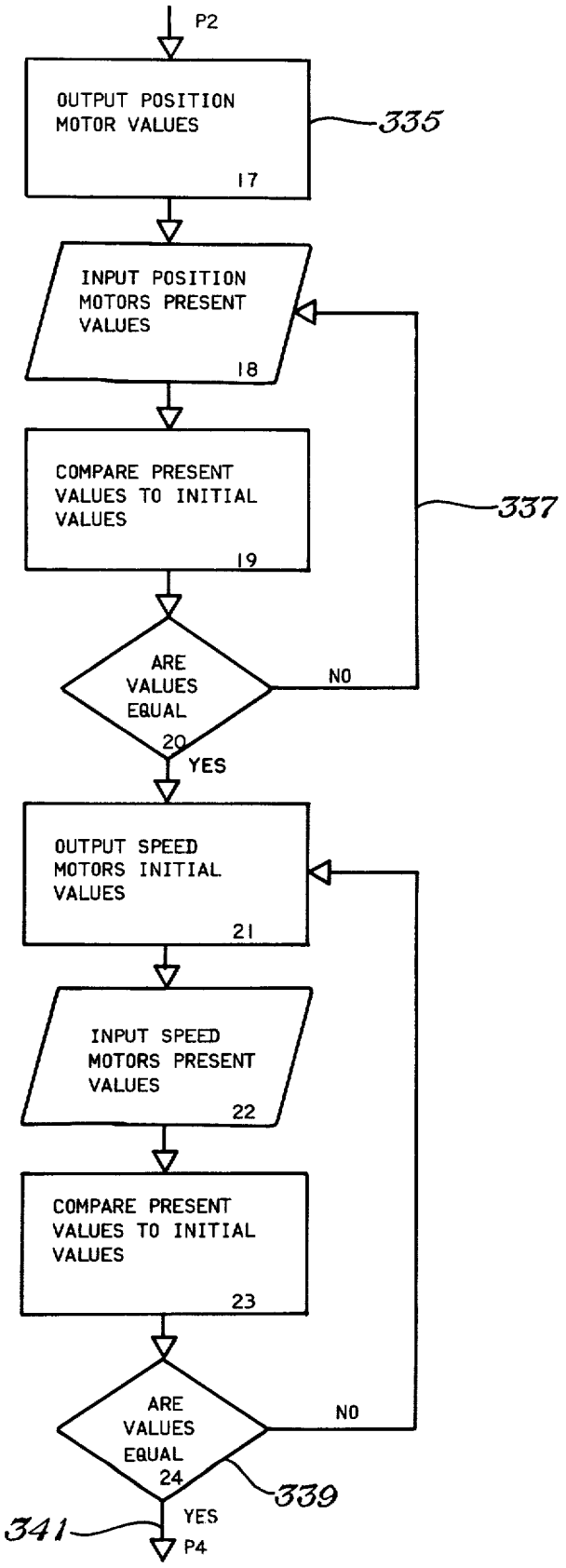

Referring to FIG. 21, the position motors are brought up to the initial position, the first loop putting an input to position the motors to desired, or present values, comparing the present value to the initial value. If the values are not equal, then the loop is made through the route 337 and keeps holding until the motors are stable at the initial values. Once the answer to the question is yes, the output to the speed motors is similarly checked and looped back to stabilize at nominal speeds. Once a yes is realized at the testing to see if the values are equal, block 339, the yes route 341 is taken. The computer then checks "is flag 1 set", FIG. 22. Expressed otherwise, the computer tests to see if whether a person is going to operate the machine on individual pitch or whether it is going to be operated off the cassette, or magazine. If the answer to the query is yes, this indicates that a person is controlling each respective pitch. The theory here is that time will be the primary controlling variable. For example, the operator may be given twenty minutes or the like starting from the circle M, number 28. In going the yes route, the computer then sets the pitch count to zero, block 26, and outputs the time allowed per game down to the counting clock in block 27.

Moving on along the program, the computer moves from the circle M to receive an input pitch velocity. This may first output a query one asking what the velocity $V_0$ is to be on the pitched ball. For example, a query may be displayed and the person selects the desired velocity from an array of velocities on the screen with the light pencil 203. To illustrate the selected velocity might be eighty-four miles per hour for initial velocity or an equivalent value in feet per second. In any event, the variable $V_0$, or velocity of the ball is input in block 30. Thereafter an input is made to the computer as to the spin vector to be given to the pitched ball in block 32. The desired spin vectors are given by rotating the baseball 211, FIG. 12 to the desired setting of the potentiometer 207 and rotating the holder 213 to obtain the desired setting on the potentiometer 209. In this way, there is accomplished the "input", for inputting the spin vector by manually positioning the spin vector potentiometers in accordance with block 32.

Figure 23:
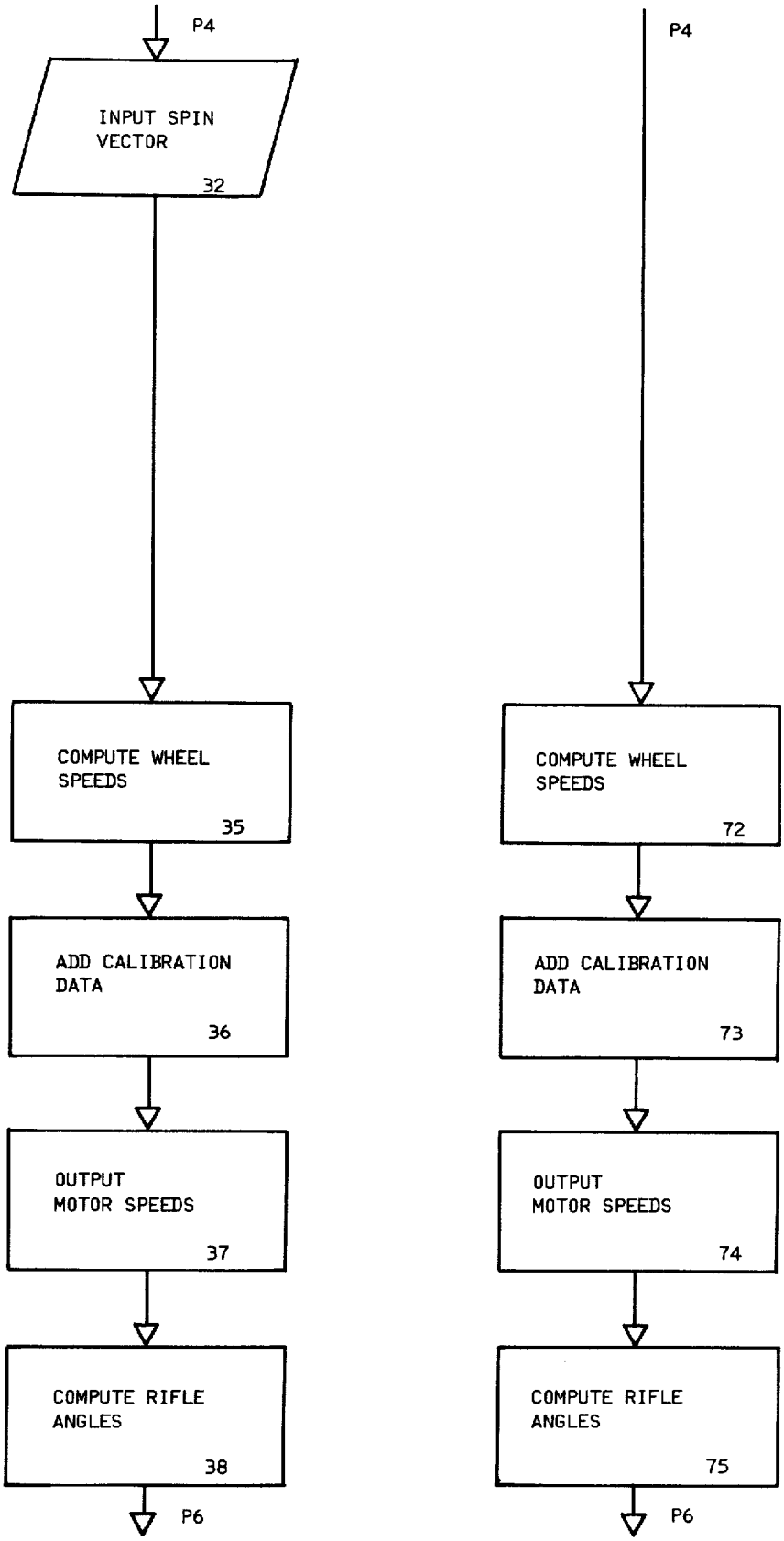

Next, the computer computes the wheel speeds for the wheels A, B, and C, block 35, FIG. 23.

Any of the mathematical algorithms or numerical approximations may be employed in the computer program to calculate the wheel speeds desired. One such method is that described hereinafter. This method is based on calculation of the great circle of the respective wheels set at 120° with one of the wheels in the vertical plane passing through the ball. The notation employed in the equations delineating the respective velocities of the great circle points are as follows:

Define a coordinate frame of axis x y z intersecting at point 21 in FIG. 1. Let axis x be into the paper, axis y horizontally to the left, and axis z vertically upward. Given v the ball velocity along the x axis, Sm the magnitude of the spin of the ball, $S\beta$ the azimuth angle of the spin vector (in the x y plane) and $S\alpha$ the altitude angle of the spin vector (from the x y plane to the spin vector). Let i j k be unit vectors along axes x y z respectively. Let a, b, and c be spin components along axes x y z respectively. Write the velocity and spin vector $$\bar{V}=vi+oj+ok \quad \text{(I)}$$

$$\bar{S}=ai+bj+ck \quad \text{(II)}$$

where

Sxy=Sm cos Sα

Sx=Sxy cos Sβ=Sm cos Sα cos Sβ=a

Sy=Sxy sin Sβ=Sm cos Sα sin Sβ=b

Sz=Sm sin Sα=c

Now relate the velocity and spin vectors to the wheels. Designate wheel A as the vertical wheel, wheel B 120° counter clockwise (ccw) from wheel A and wheel C 120° clockwise (cw) from wheel A. Let point A be a point on the ball touched by wheel A; point B by wheel B; and point C by wheel C. Determine the total velocity requirements of the ball at each of the three points. Let r equal the radius of the ball and let re equal the effective radius a wheel has with respect to the coordinate system. Now delineate the effects of the velocity and spin requirements at each point Due to $Sx = ai$ $$\text{at } A\ Ai = a\frac{re}{r} = a \quad \text{(III)}$$

$$\text{at } B\ Bi = a\frac{re}{r} = a \quad \text{(IV)}$$

$$\text{at } C\ Ci = a\frac{re}{r} = a \quad \text{(V)}$$

Due to $Sy = bj$ $$\text{at } A\ Aj = b\frac{re}{r} = b \quad \text{(VI)}$$

$$\text{at } B\ Bj = b\frac{re}{r} = \frac{b(-r\sin 30°)}{r} = -b\sin 30° \quad \text{(VII)}$$

$$\text{at } C\ Cj = b\frac{re}{r} = \frac{b(-r\sin 30°)}{r} = -b\sin 30° \quad \text{(VIII)}$$

Due to $Sz = ck$ $$\text{at } A\ Ak = c\frac{re}{r} = \frac{c(o)}{r} = o \quad \text{(IX)}$$

$$\text{at } B\ Bk = c\frac{re}{r} = \frac{c(-r)\cos 30°}{r} = c\cos 30° \quad \text{(X)}$$

$$\text{at } C\ Ck = c\frac{re}{r} = \frac{c\,r\cos 30°}{r} = c\cos 30° \quad \text{(XI)}$$

Summing the requirements for velocity (wheel rim linear velocity)

$$A=[a^2+(b+v)^2]^{\frac{1}{2}} \quad \text{(XII)}$$

$$B=[a^2+(v-b\sin 30°-c\cos 30°)^2]^{\frac{1}{2}} \quad \text{(XIII)}$$

$$C=[a^2+(v+c\cos 30°-b\sin 30°)^2]^{\frac{1}{2}} \quad \text{(XIV)}$$

Thereafter, as noted by block 36, the computer "adds" the calibration data obtained from previously run tests. The data relates the tire speed to motor voltage (i.e. motor speed). Alternately, an equation can be used to represent the test data hence making the calibration on the corrected speed. The corrected speed is speed determined when the calibration for the centrifugal force on the tire and other such variables is "added" for a given inflation and speed of the tire. The resulting final wheel speed is then output to the respective wheel motors, following conversion to rotational speeds or analog speeds in accordance with conventional technology, as noted in block 37.

Next the computer computes the rifle angle $\rho_a$, $\rho_b$, and $\rho_c$ for the respective three wheels, as shown in block 38. The respective rifle angles are computed as defined by equations XV-XVII.

$$\rho_a=\tan^{-1}[a/(b+v)] \quad \text{(XV)}$$

$$\rho_b=\tan^{-1}[a/(v-b\sin 30-c\cos 30)] \quad \text{(XVI)}$$

$$\rho_c=\tan^{-1}[a/(v+c\cos 30-b\sin 30°)] \quad \text{(XVII)}$$

The respective rifle angles are then output for effecting the desired rifle angle position. Responsive to the computer output, the rifle angle positioning motors then go to the proper positions and retain this position.

Next, the computer queries the respective vertical and horizontal distance to the release point, or feed point for the ball 31. Through the light pencil or other suitable media, the desired $Y_s$ and $Z_s$ is input in accordance with block 41. The computer then computes the respective positions needed by the motors to obtain the desired release point and outputs $Y_s'$ and $Z_s'$, as shown in block 43.

Next, there is a query as to the target zone $X_t$, $Y_t$ and $Z_t$. This is equivalent to the range, width and height of the point of impact. For example, in a pitching machine, this would be the strike zone or a desired position within the strike zone or adjacent thereto.

Figure 24:
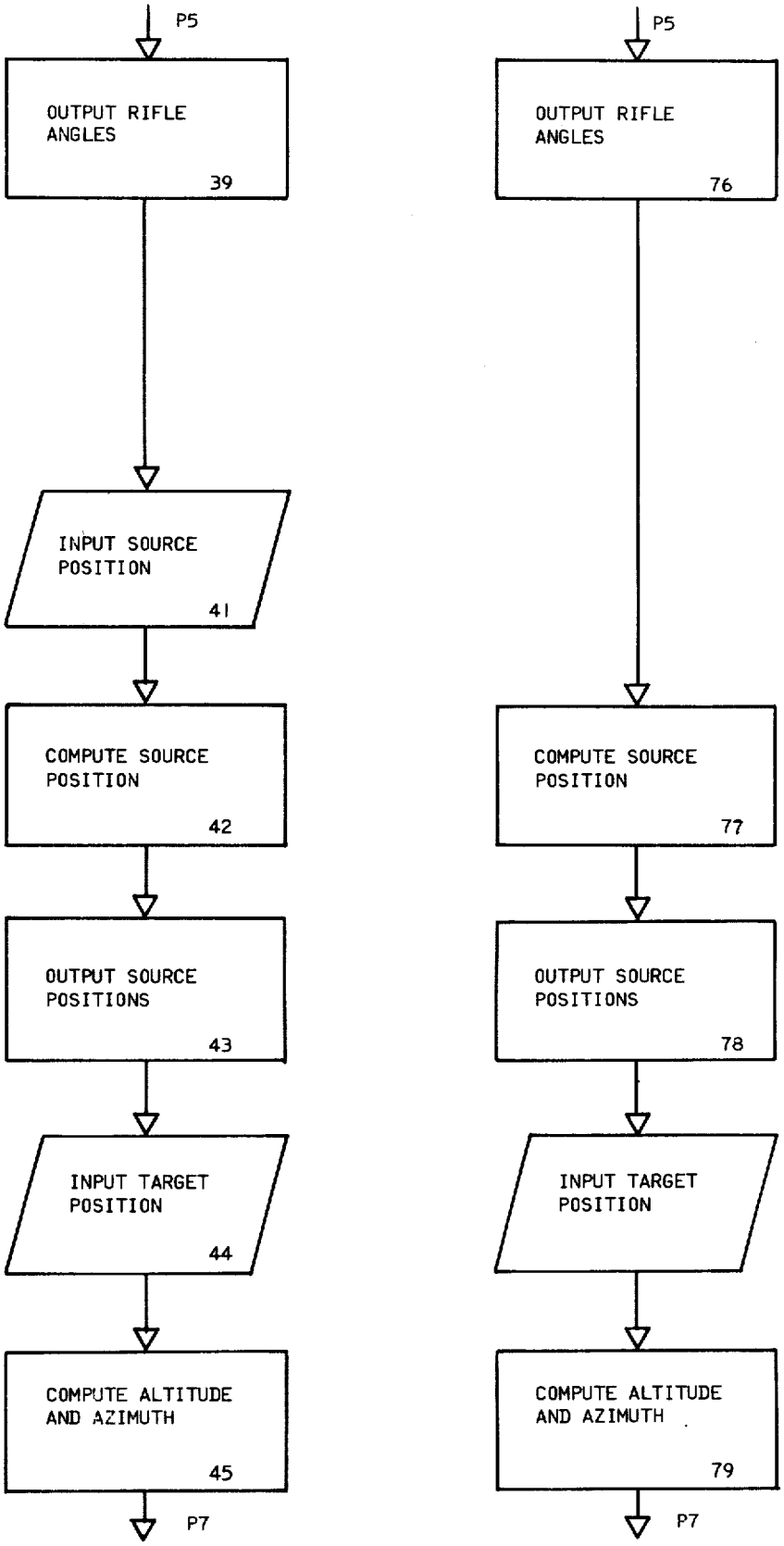

Next, the computer computes the altitude and azimuth angle positions required to satisfy the respective inputs given, as shown by block 45, FIG. 24. In essence, the computer is asked to predict the target point for the ball to see if it is going to hit in the strike zone properly. If it is not within the target zone then the computer is asked to recompute the altitude and azimuth to obtain the desired target zone. Thus, it is, in effect, a computational and error solution similar to a relaxation calculation for temperature distribution and the result is a profile similar to that displayed in FIG. 17*a*. It is to be noted that the computer must also correlate the velocity and spin vectors with the wind velocity and direction, or the negative of the wind vector in actuality. Also, there is the gravity vector that must be expressed vectorially downward. And finally, there is a correction for the direction of lift and drag. In essence, there is obtained the lift magnitude from the expression, the fluid mass density, the area of the object, the coeffecient of lift, the magnitude and the velocity times the magnitude of the spin divided by two times the force of gravity. However, the coeffecient of lift is a function of the spin, the velocity and the angle between them. The mathematics involves the actual crossing of the vectors into each other and will be expressed mathematically before further discussion is given.

Specifically, in block 45, the computer computes the rotated velocity and spin vectors by the amount of the azimuth and the altitude angles. The velocity vector is given by Equation XVIII.

$$\vec{V}=d\vec{i}+e\vec{j}+f\vec{k} \quad \text{(XVIII)}$$

In like manner, the spin vector $\bar{S}$ is given by Equation XIX.

$$\vec{S}=n\vec{i}+h\vec{j}+l\vec{k} \quad \text{(XIX)}$$

where $|\vec{S}|=(n^2+h^2+l^2)^{\frac{1}{2}}$, the spin magnitude. Note the negative of the wind vector $\vec{w}$ is given by Equation XX $$\vec{w}=a_2\vec{i}+b_2\vec{j}+c_2\vec{k} \quad \text{(XX)}$$

There is obtained the $\vec{V}$ by the Equation XXI $$\vec{V}=\vec{V'}+\vec{w}=(a_2+d)\vec{i}+(e+b_2)\vec{j}+(f+c_2)\vec{k} \quad \text{(XXI)}$$

where $|\vec{V}|=[(d+a_2)^2+(e+b_2)^2+(f+c_2)^2]^{\frac{1}{2}}$ It is to be recalled that the gravity vector $\vec{G}$ is given by Equation XXII $$\vec{G}=p\vec{k} \quad \text{(XXII)}$$

Obtain $\vec{L'}=\vec{S}\times\vec{V}$, the direction of lift due to spin and velocity.

$$\vec{L'}=q\vec{i}+u\vec{j}+s\vec{k} \quad \text{(XXIII)}$$

$$\text{Obtain lift magnitude } L''=\frac{\rho A C_L}{2g}(VS) \quad \text{(XXIV)}$$

$\rho$=fluid (air) density
A=area of object (ball)
$C_L$=coeficient of lift
$C_L$ is a function of S, V, and the angle between them.
Distribute the lift magnitude L'' on the lift direction $\vec{L'}$ $$\vec{L}=\frac{q}{|\vec{L'}|}L''\vec{i}+\frac{u}{|\vec{L'}|}L''\vec{j}+\frac{s}{|\vec{L'}|}L''\vec{k} \quad \text{(XXV)}$$

Obtain drag magnitude $$D''=\frac{\rho A C_D|\vec{V}|^2}{2q}$$

$C_D$ = coef of drag is weakly $\left|\frac{\vec{S}}{\vec{V}}\right|$ dependent

Distribute drag magnitude D'' on drag direction—$\vec{V}$ $$\vec{D}=-\frac{(a_2+d)D''\vec{i}}{|\vec{V}|}-\frac{(e+b_2)D''\vec{j}}{|\vec{V}|}-\frac{(f+c_2)D''\vec{k}}{|\vec{V}|}$$

Add the lift, drag and gravity vectors to obtain the total force on the ball.

$$\vec{F}=\left[\frac{qL''}{|\vec{L'}|}-\frac{(d+a_2)D''}{\vec{V}}\right]_{\vec{i}}+\left[\frac{u}{|\vec{L'}|}L''-\frac{(e+b_2)D''}{|\vec{V}|}\right]_{\vec{j}}+\left[\frac{sL''}{|\vec{L'}|}-\frac{(f+c_2)D''}{\vec{V}}+p\right]_{\vec{k}} \quad \text{(XXVI)}$$

$$|\vec{F}|=Fxn+Fyn+$$

-continued $$Fzn \text{ where: } Fxn=\frac{qL''}{|\vec{L'}|}-\frac{(d+a_2)D''}{|\vec{V}|}$$

$$Fyn=\frac{uL''}{|\vec{L'}|}-\frac{(e+b_2)D''}{|\vec{V}|}$$

$$Fzn=\frac{sL''}{|\vec{L'}|}-\frac{(f+c_2)D''}{|\vec{V}|}+p$$

Assume constant acceleration for an interval and compute:

$$\text{for } x\ Xn+1=Xn+V_{xn}t+\frac{Fxn}{2m}t^2$$

$$\text{for } y\ Yn+1=Yn+V_{yn}t+\frac{F_{yn}}{2m}t^2$$

$$\text{for } z\ Zn+1=Zn+V_{zn}t+\frac{F_{zn}}{2m}t^2$$

$$\text{for } x\ V_x(n+1)=V_{xn}+\frac{F_{xn}t}{2m}$$

$$\text{for } y\ V_y(n+1)=V_{yn}+\frac{F_{yn}t}{2m}$$

$$\text{for } z\ V_z(n+1)=V_{zn}+\frac{F_{zn}t}{2m}$$

Compare Xn+1 to Xt. If less return to LBL1. Iterate until Xn+m=Xt then compare Yn+m to Yt and Zn+m to Zt. If not equal determine a change to altitude ($\alpha$) and azimuth ($\beta$). Make the change by rotating the vectors $\vec{V'}$ and $\vec{S}$ and iterate until $X=X_t$, $Y=Y_t$ & $Z=Z_t$.

To calculate is to sum up all the forces on the ball and predict the flight in order to get it within the target area. As depicted in FIG. 17A, the iteration positions of the ball may be shown after the calculations following each interval of time predicted flight.

Figure 25:
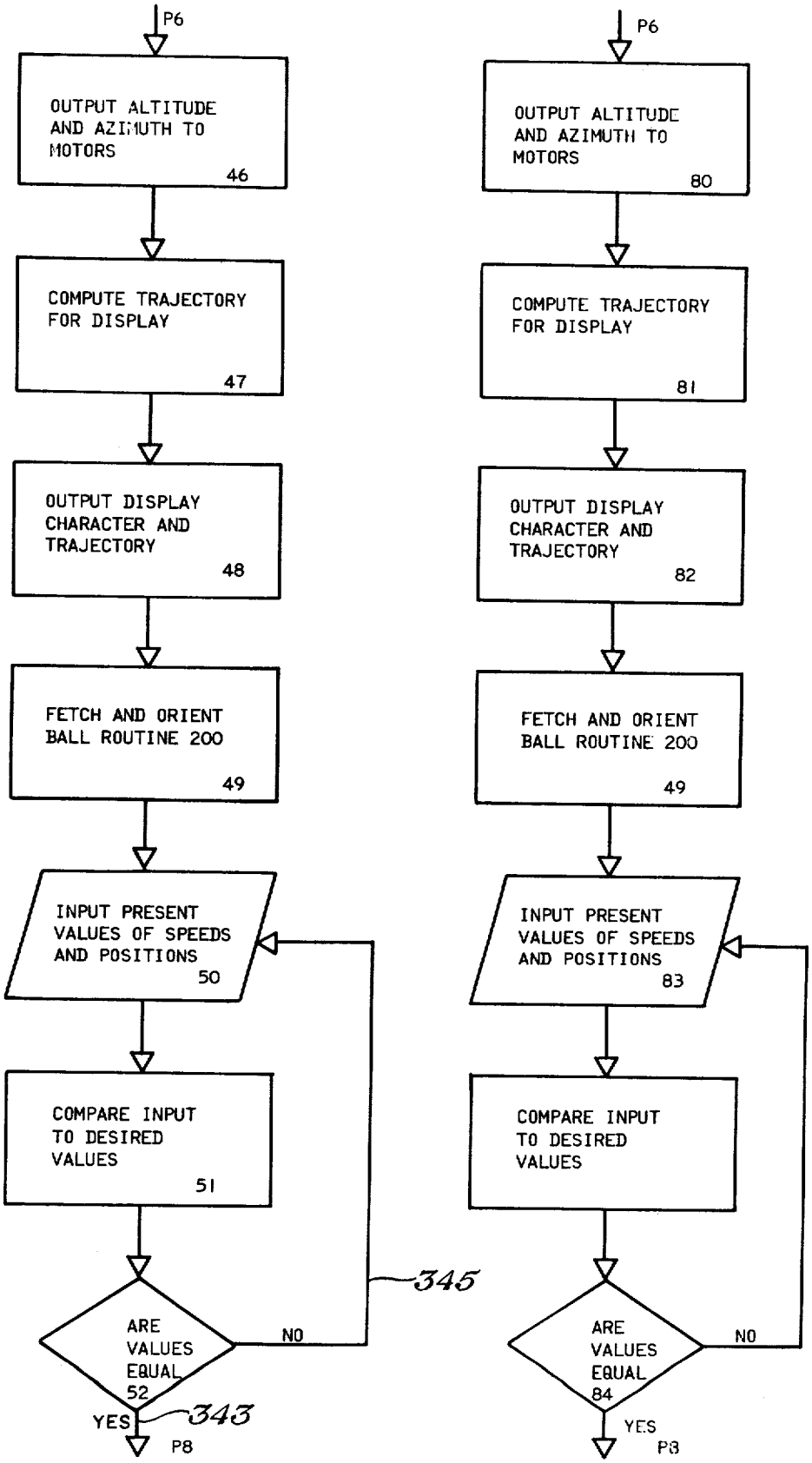

Referring to FIG. 25, the respective (alpha) altitude and (beta) azimuth are then output to the motors and the trajectory is computed for display in block 47. The display character and trajectory is output in block 48. Thereafter, the computer goes into the fetch and orient ball routine to get the ball ready for pitch, block 49.

The fetch and orient the ball routine may be as simple as allowing a ball to be rolled into position for being fed. Preferably, a specific sub routine has been developed that automatically effects the same relative position of a ball before it is thrown and will be described later hereinafter.

In block 50, the general check is made of the variables that are input, compared in block 51. If the values are equal the yes route 343 is followed. If not, the no route 345 is followed until the machine is ready to pitch.

Figure 26:
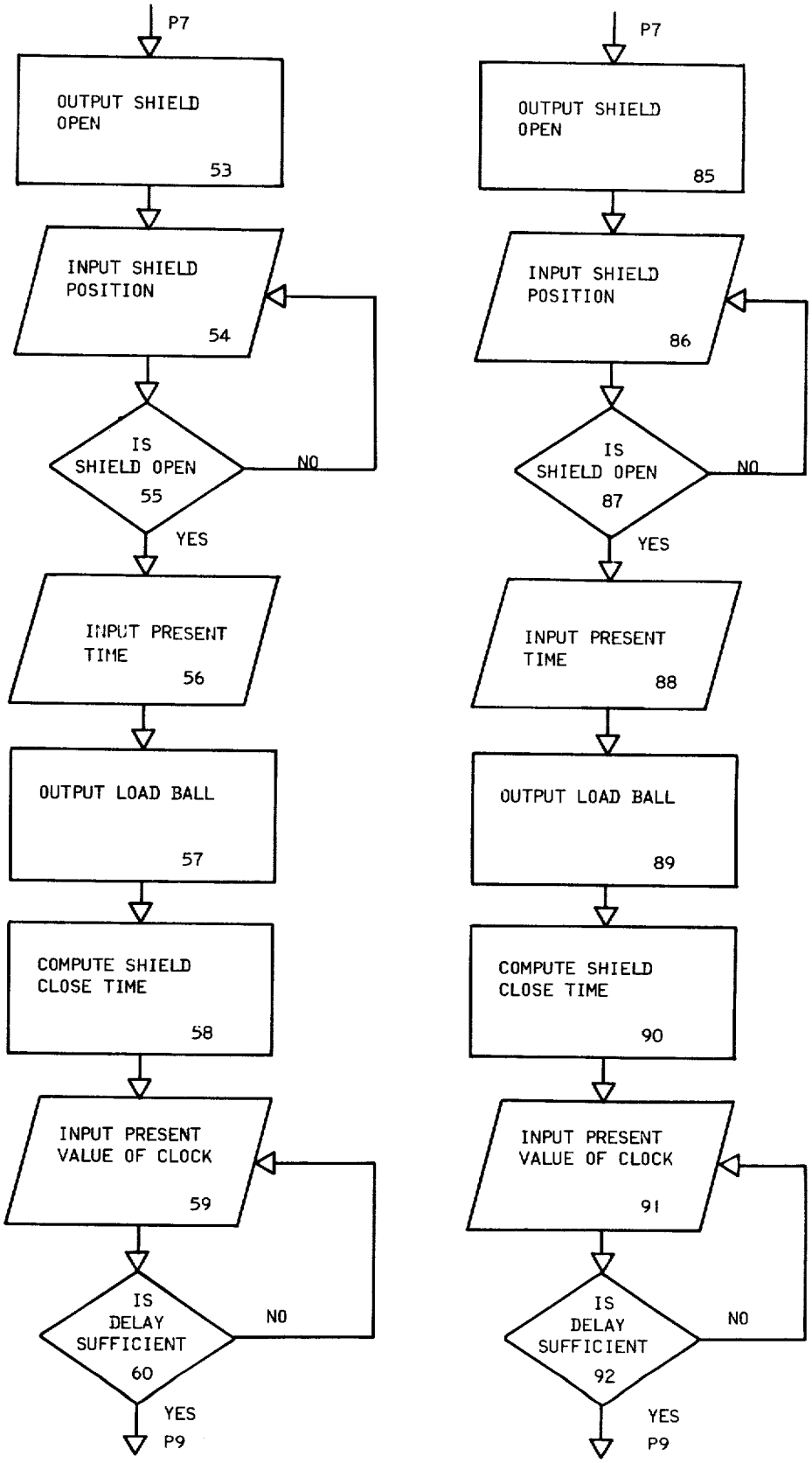

As can be seen in FIG. 26, the computer then outputs, in block 53, to open the shield; and checks in blocks 54 and 55 to insure that the shield is opened before the pitch is made. In block 56, the present time is input and in block 57, there is a signal given to load the ball. This effects a pitching of the ball because it is fed to the correctly spinning wheels.

The shield is left open just long enough for the ball to go through the shield so the shield close time is calculated for the velocity of the ball in block 58. Thereafter, in block 59, the shield is closed before the ball can be hit back to the machine.

Figure 27:
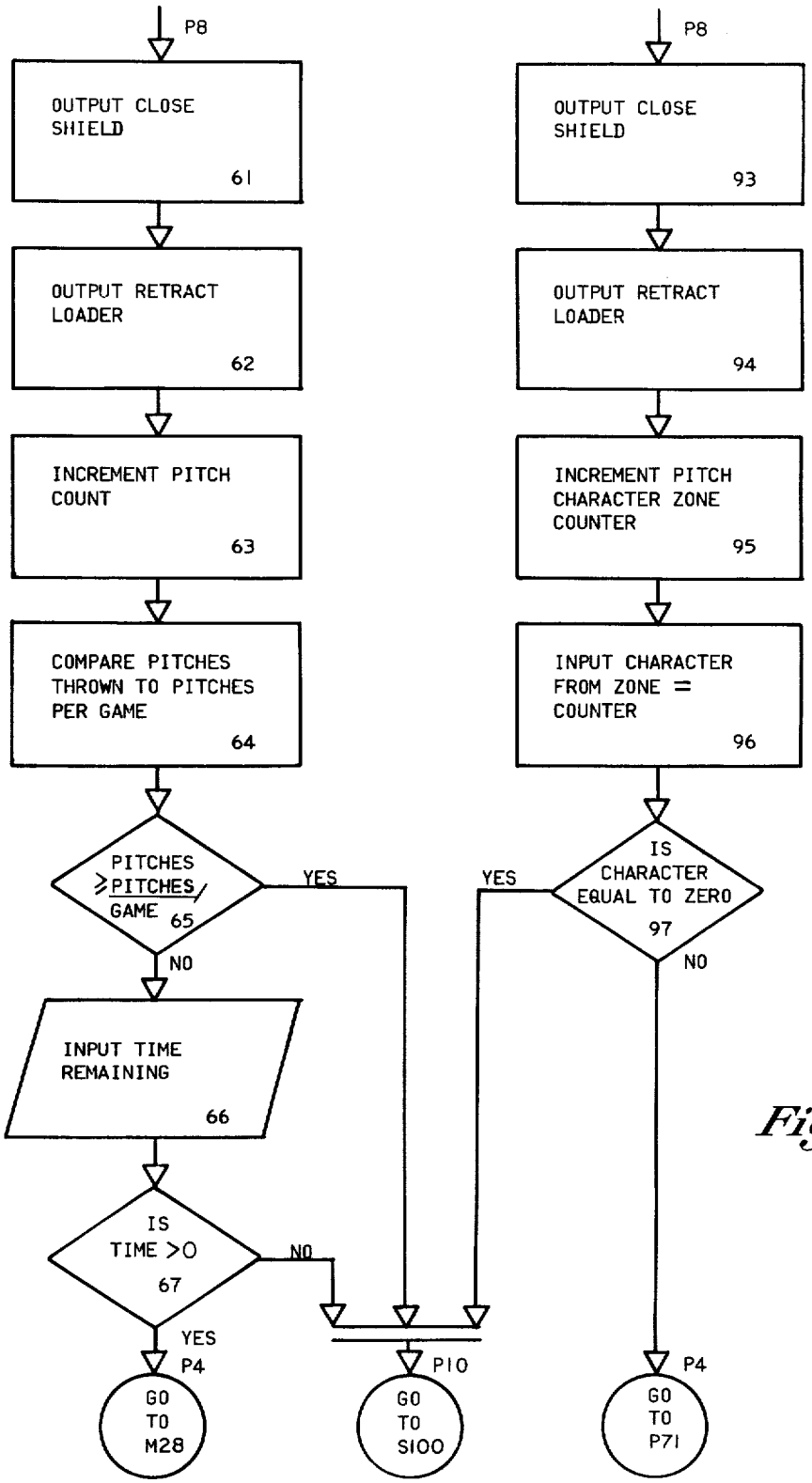

Referring to FIG. 27, the computer then outputs to close the shield in block 61 and to retract the loader in block 62. This gets the loader out of the way and prepares for the next orientation motion if it is employed. In block 63 there is an incremental pitch count that is compared in block 64. As illustrated in block 65, if the pitch is equal to or exceeds the pitches per game then go to the stop routine S, circle 100. If no then the input time remaining is given in block 66 and is checked in block 67 so that if the time has been used up then again go to the stop routine circle 100, FIG. 28. If the time has not been used up then another pitch is effected by going back to p4, FIG. 22 to effect another pitch.

Figure 28:
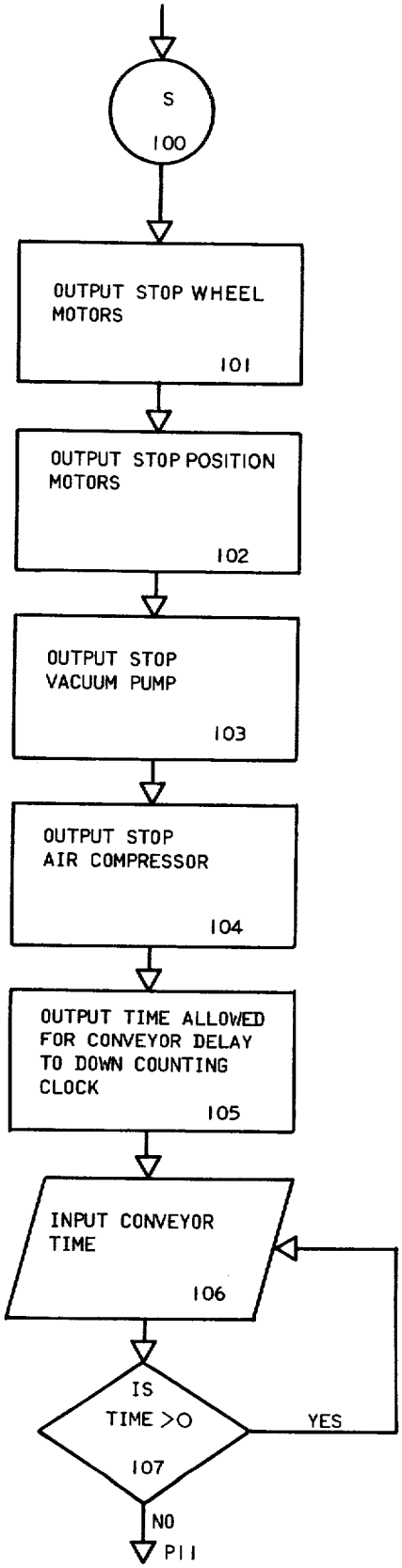
FIGS. 28 and 29 are portions of a flow diagram of a "stop" sub-routine of the computer program of FIGS. 19–27.
Figure 29:
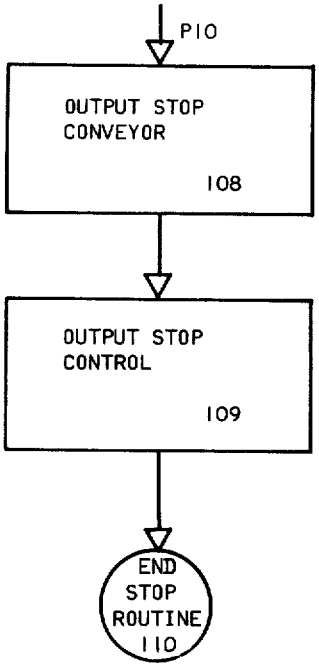

If entry is made to the stop routine, FIG. 28, there is an output in block 101 to stop the wheel motors. There is also an output in block 102 to stop the other motors for effecting the altitude, azimuth, height and width of the initial point. In block 103 the vacuum pump is stopped. In block 104 the air compressor is stopped. The conveyer is kept going in block 105 to give time for all the balls to be collected. Present time is input in block 106 and compared. If greater than zero, the conveyor is kept going. If no there is an output in block 108, FIG. 29 to stop the conveyer. In block 109 and 110, the end routine is stopped and the machine is shut down.

Figure 22:
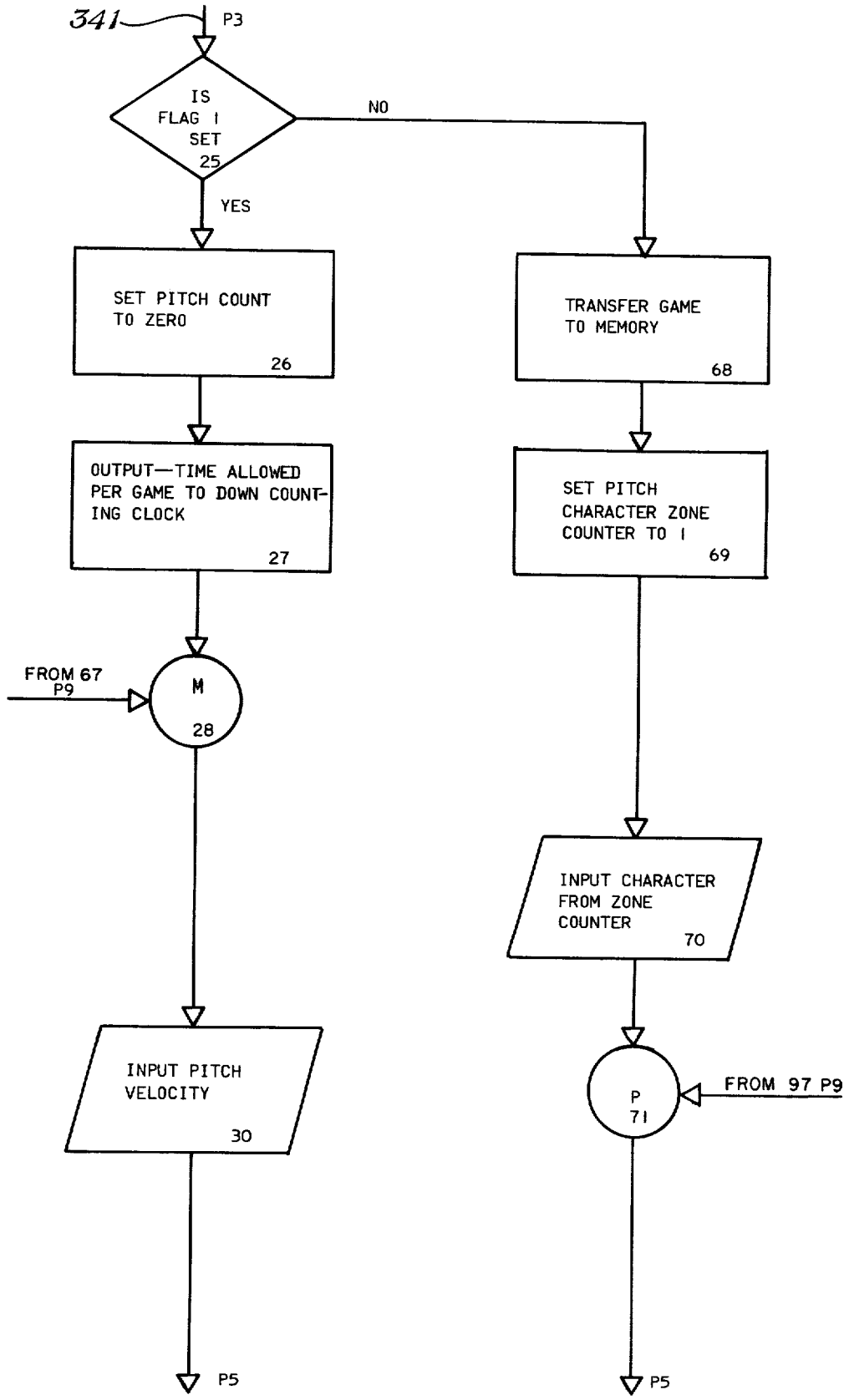

If the answer to the question is the flag one set, block 25, FIG. 22, is no, this means the machine will be controlled by the center. Accordingly the character of each pitch is transferred into memory in block 68. The pitch character for a particular game is then set in to start the first pitching game in block 69 and the input is made in block 70. In circle p71, the computer routes its self on to compute the wheel speed in block 72. This is analogous to the computation described hereinbefore with respect to block 35. Similarly, in blocks 73 and 74 the calibration data is added and the speeds are output to the motors. Thereafter, the rifle angles are computed in blocks 75 similarly as described hereinbefore with respect to block 38.

The respective rifle angles are computed and output in blocks 76. The release point is computed and output in blocks 77 and 78. The altitude and azimuth are computed in block 79 and output to the motors in block 80. Similarly, the trajectory for display, the fetch and orienting of the ball, the inputing of values and comparison in blocks 83–84 are similar to that described heretofore with respect to blocks 50 to 52. In like manner the shield is opened, the ball thrown, and the shield closed. Similarly the loader is retracted in block 94, FIG. 27, the increment pitch character zone counter is made and checked with that given by the center. If the two are equal, the exit is made by the yes route to the stop routine. If no, reentry is made at circle P 71, on FIG. 22.

The ball fetch routine may be understood by referring to FIGS. 30–39. It should be born in mind that the accomplishment that is to be realized is to pick up a ball from a feed tray, tube, or the like and effect a rotation of the ball until a sensor senses the passage of two seams and then rotationally backs up the particular spindle halfway between the two seams and then allows the ball to be picked up by the other spindle where the rotating process is repeated. When both spindles have performed alternately three times, the ball is always in a standard position for being feed to the spinning wheels 15. Thus, while the computer sub routine shown in FIGS. 31–39 appears complex because of the sheer number of operations performed, the operation is, in fact, simple and uncomplicated in theory and motion.

Figure 30:
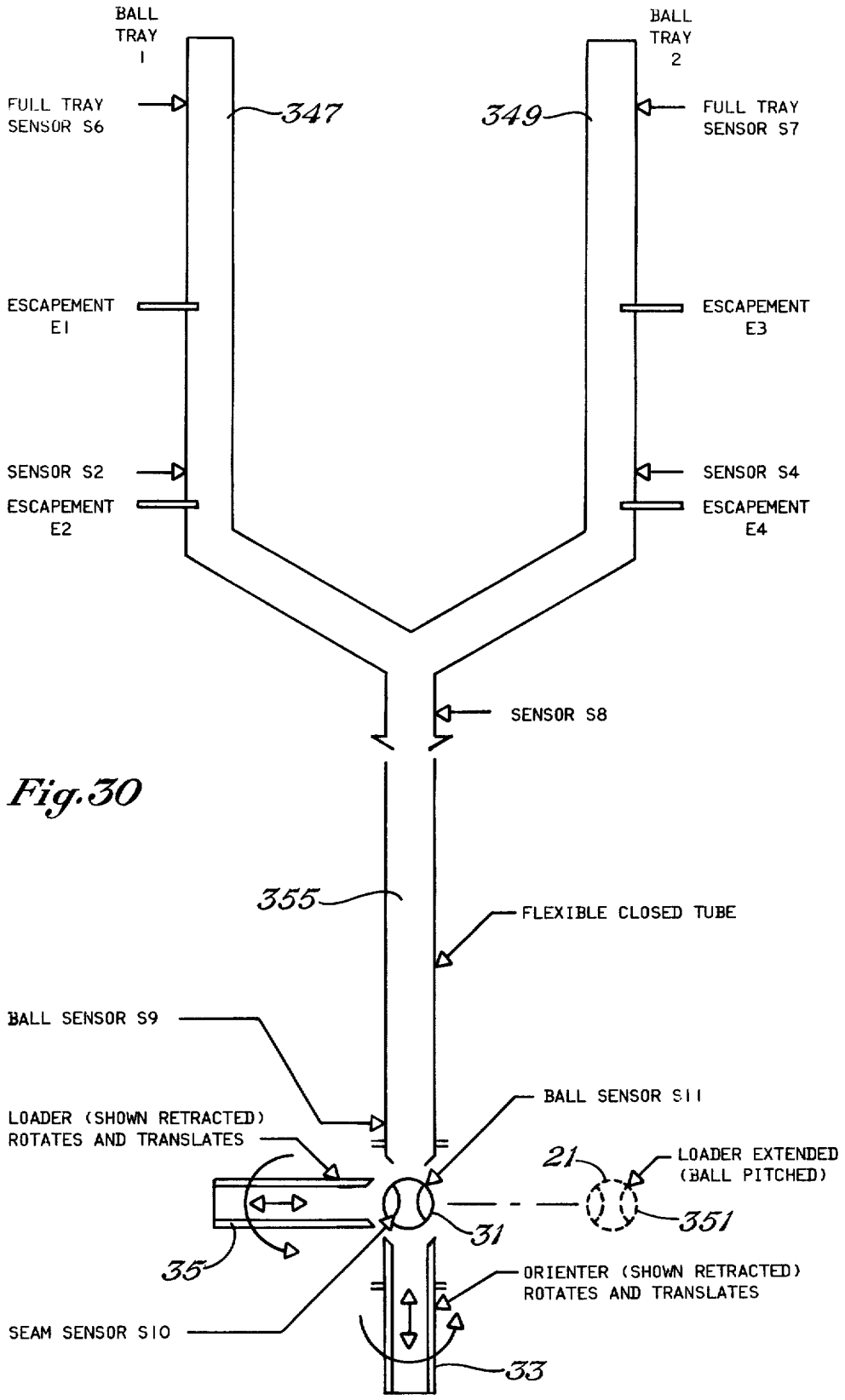
FIG. 30 is a schematic illustration of a ball feeding apparatus having parallel trays and gates.
Figure 31:
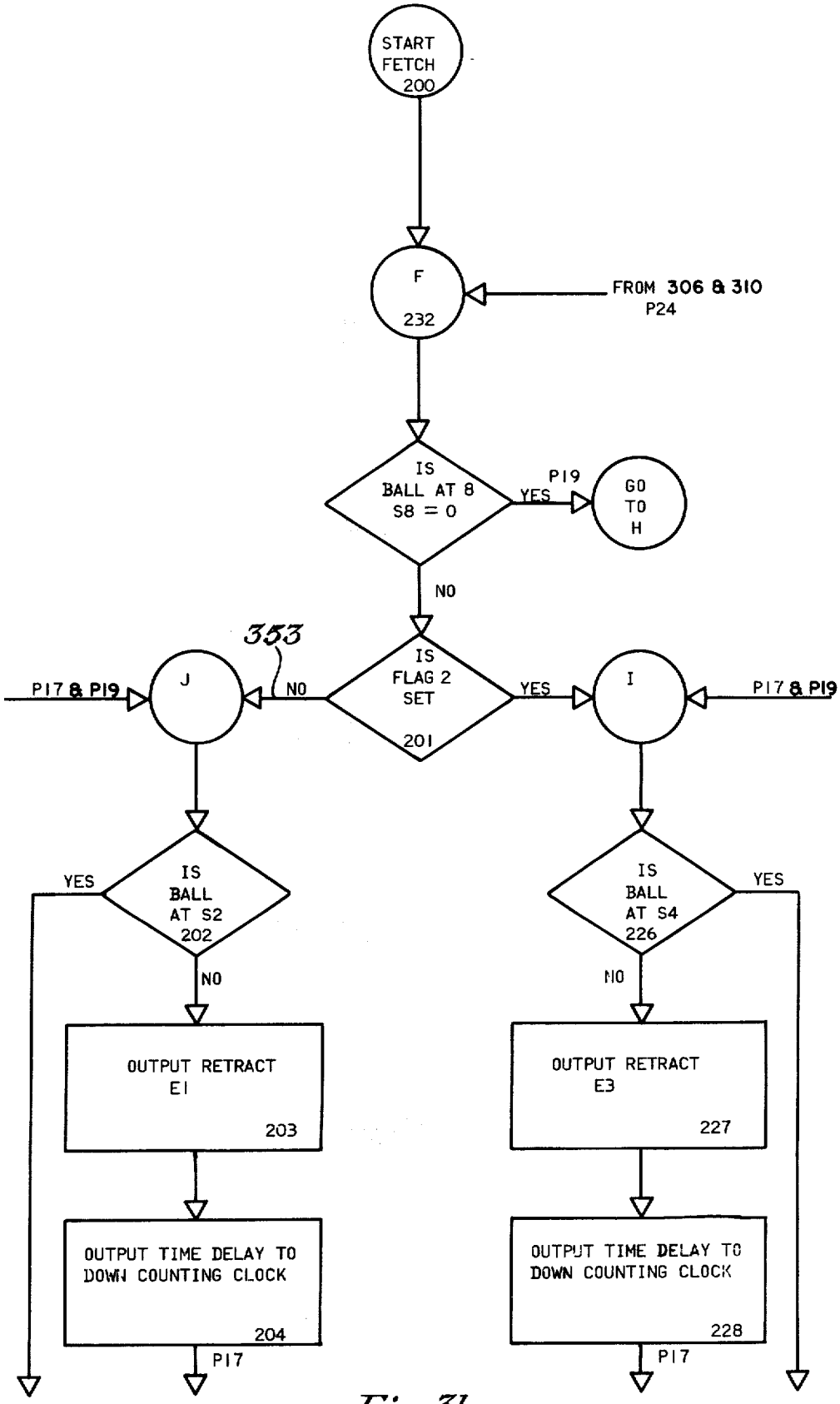
FIGS. 31–39 are portions of a flow diagram of a ball orienting sub-routine for the system of FIGS. 18 and 30.
Figure 32:
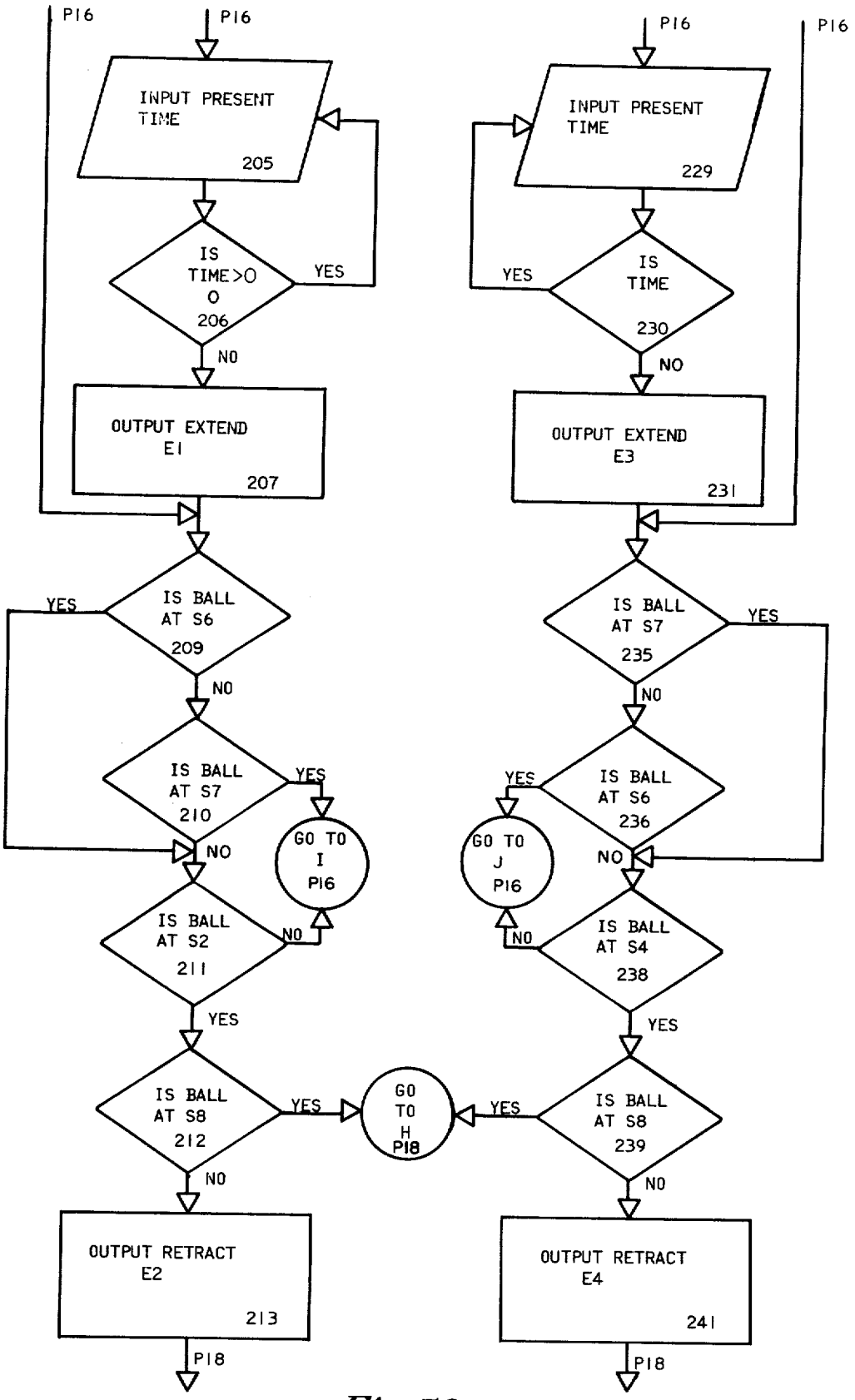
Figure 33:
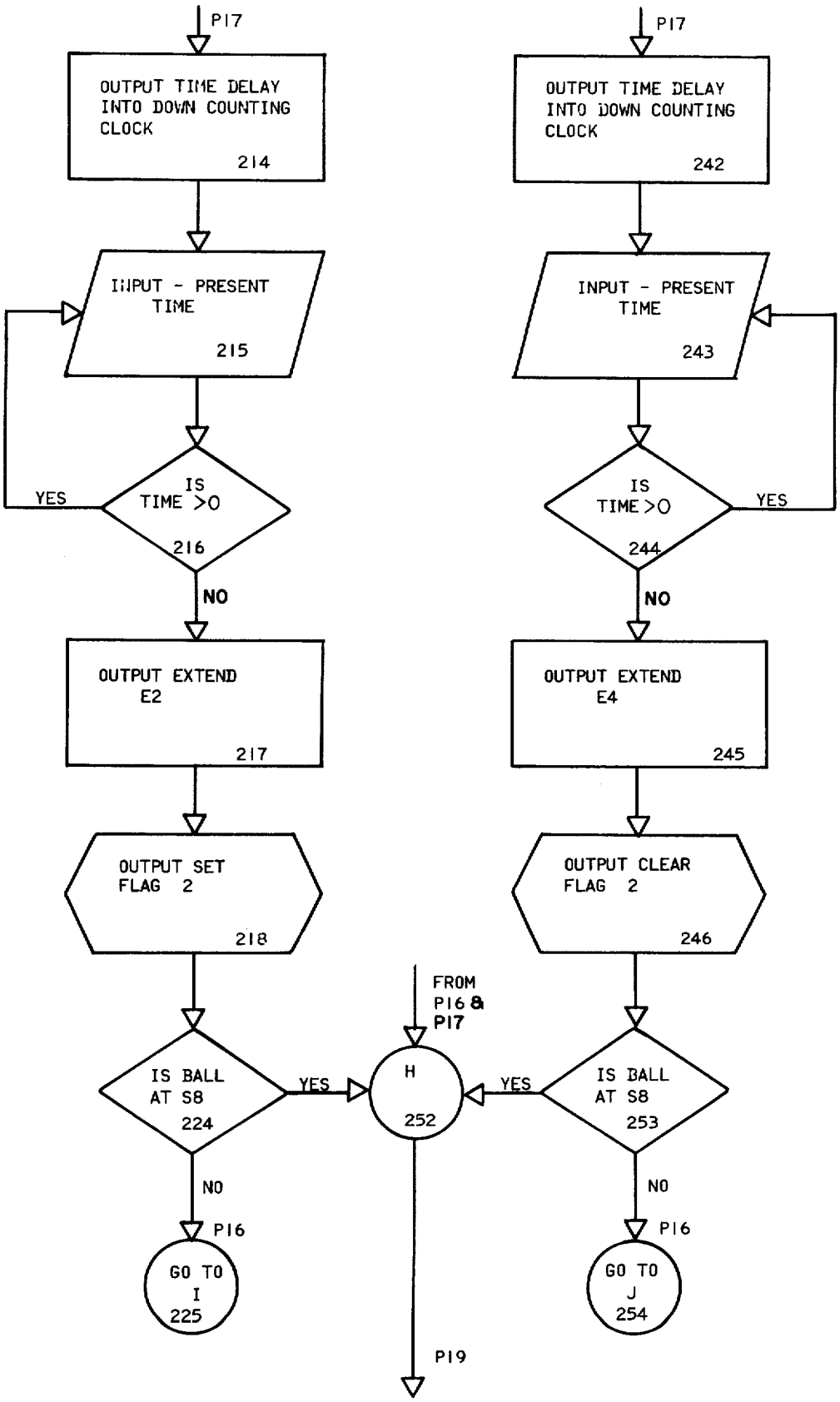
Figure 34:
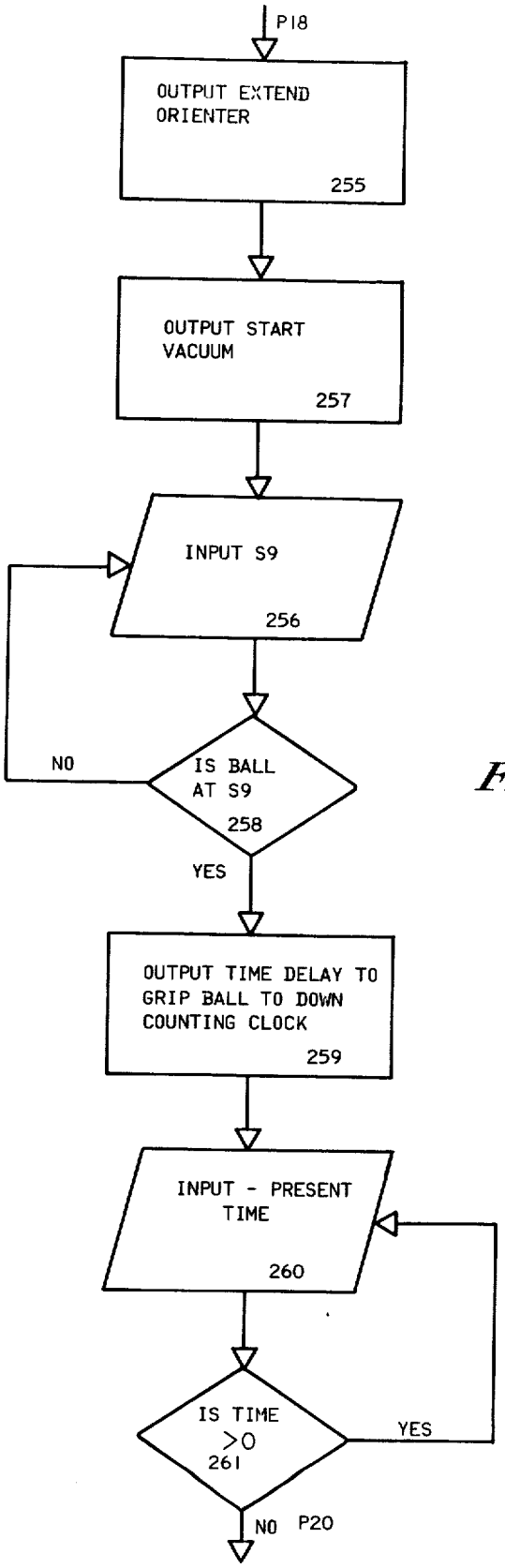
Figure 35:
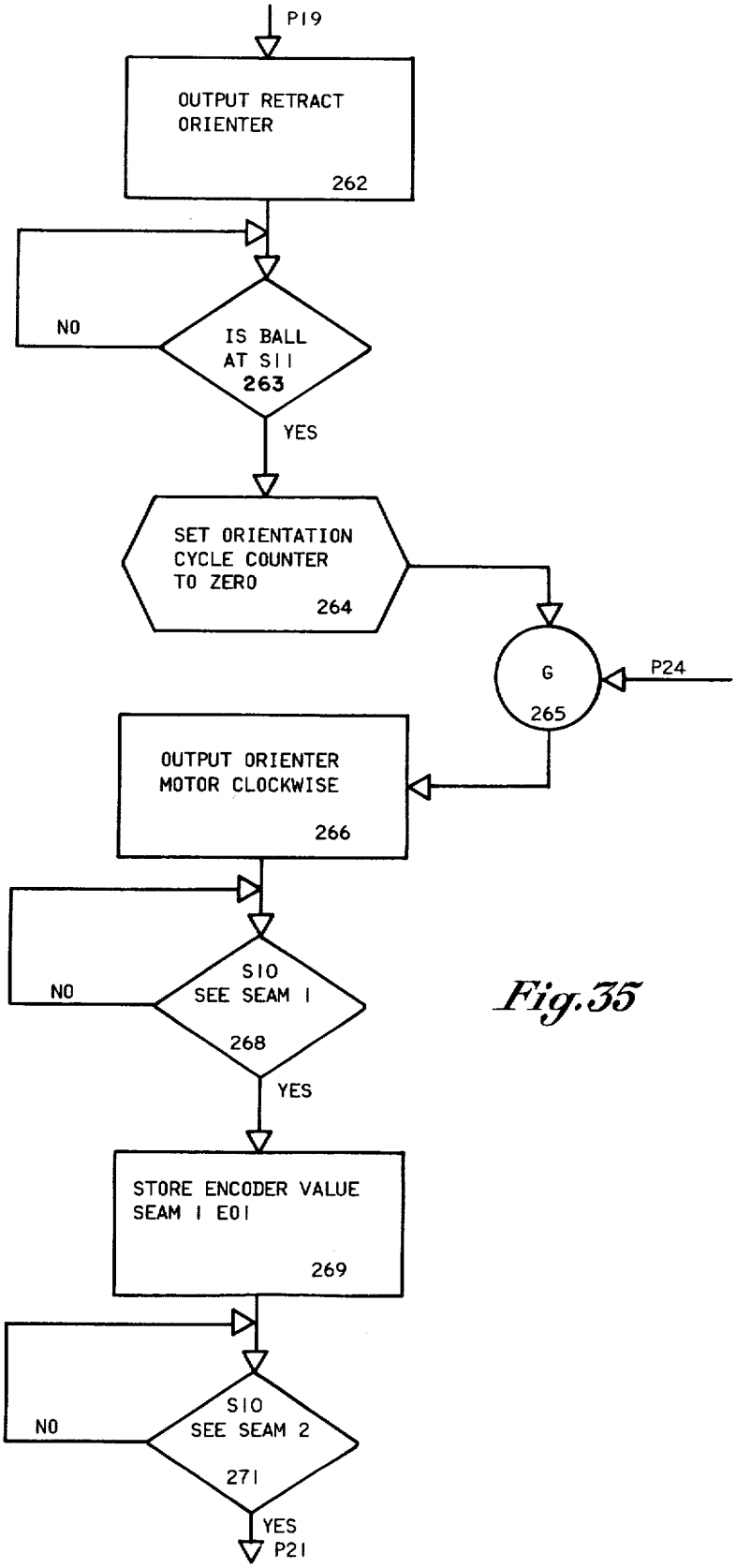
Figure 36:
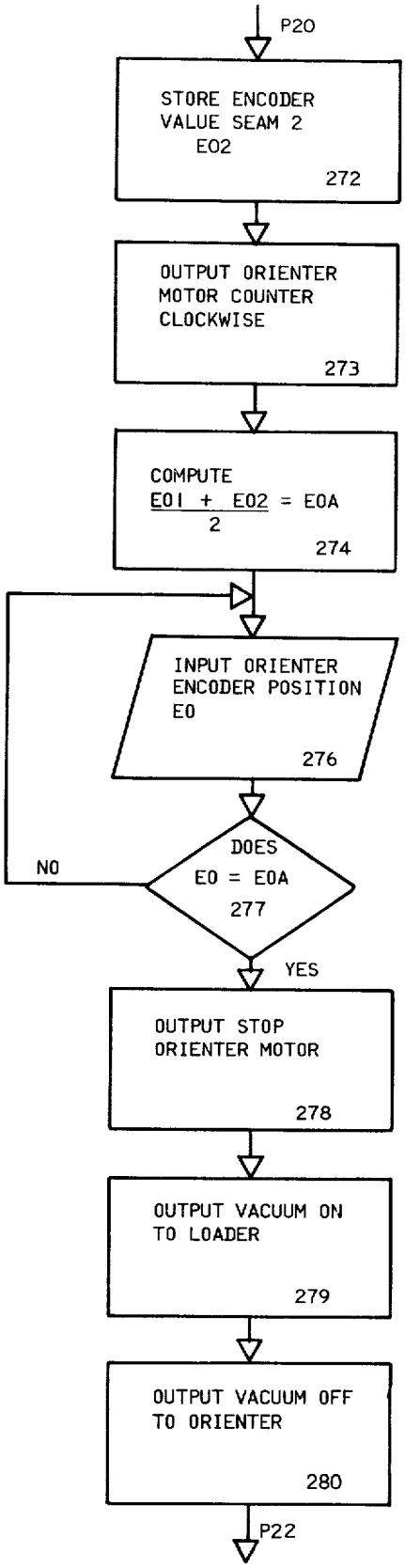
Figure 37:
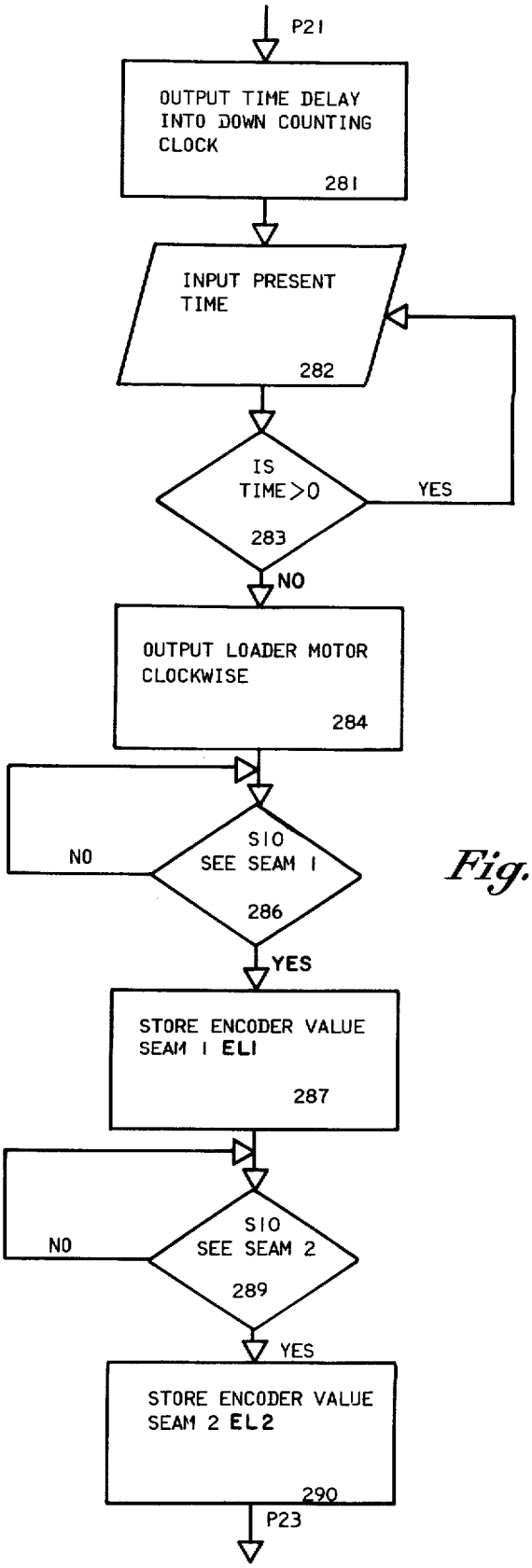

Referring to FIG. 30, there are two trays 347 and 349. These trays are frequently merely upwardly extending chutes such that the force of gravity feeds the ball downwardly thru the respective trays past respective sensors designated $S_2$ thru $S_8$ sensing whether or not there are balls at the respective locations. Gates E1–E4 allow a ball to proceed upon a suitable signal from the computer. Once the ball 31 is at sensor $S_8$ and upon suitable signal, the orienter 33 extends to form a vacuum seal with the flexible closed tube 355 and pulls the ball by vacuum to S9. The ball forms a seal with 37 and is then held on the orienter by the vacuum. Thereafter, the loader and orienter rotate the ball until the sensor sees the two seams, back the ball up halfway until it is in the standard orientation after three such cycles. The loader 35 holds the ball by vacuum and extends it into the feed position 351, with the center at the feed point 21.

The specifics of accomplishing this are shown in FIGS. 31–39. Thus the start of the fetch routine is begun at circle 200. Thereafter, the computer asks is a ball at $S_8$ (sensor 8). If yes, the computer sub routine goes to H, circle 252, FIG. 33. If no, the computer asks is flag 2 set in diamond 201. This in effect alternates between the trays for the first attempt to feed a ball. If the answer is no, the no route 353 is taken to circle J. The computer then queries if $S_2$ is equal to zero in diagonal 202. If the answer is yes, the computer then proceeds to block 209. If the answer is no, this is a signal there is no ball at the gate $E_2$ so the computer effects a release of a ball. Specifically it outputs to gate $E_1$ in block 203. The output to $E_1$ delays to the down counting clock in block 204. Present time is input in block 205 and is checked in block 206 until down counting time is zero or less. This would release a ball from gate $E_1$ and allow it to fall to the sensor $S_2$. Thereafter the computer proceeds to block 209. The computer asks is $S_6$ equal to zero in block 209. If a ball is at $S_6$, it signals the tray is full. If there is no ball at $S_6$ the computer checks the other tray by quering of $S_7$ in block 210. If yes, the computer goes to circle I.

Returning now to block 201, if the answer is yes to the flag set, the computer goes thru the same set of inquiries with respect to the right hand tray 349. Specifically the computer goes via circle I to block 226 and queries whether sensor $S_4$ senses a ball. If yes it goes to block 235. If no, there is an output to $E_3$ to open it sufficiently long to allow a ball to pass thru and proceed to block 235. The computer then proceeds to inquire of sensor $S_7$ if the right hand tray is full. If yes, the tray is full. If not, the computer then checks with the other tray $S_6$. If yes the computer goes to circle J. In block 211 the computer inquires of $S_2$ if a ball is there. If there is a ball, it is released and the computer inquires of $S_8$ if a ball is at that point in block 212. If no, then there is output of gate $E_2$ to open it in block 213 with suitable time delay to allow ball to pass thru in blocks 214–216. Once there is an output to close gate $E_2$, the flag 2 is set in block 218, FIG. 33. Then the computer inquires in block 244 if the sensor $S_8$ is equal to zero. If there is a ball at $S_8$ the computer proceeds to H, circle 252, FIG. 33. If there is still not a ball at $S_8$ in block 224, the computer is sent across to the right tray to I in circle 225.

In like manner, the computer handles the right hand tray with its sensors and gates to obtain a ball at $S_8$ ready to enter the chute 355, FIG. 30. Of course, if the answer to the respective queries in blocks 212 and 239 were yes that a ball was already at $S_8$, the computer would then go directly thru H in circle 252 to blocks 255 and 257 to extend the orienter 33 and start the vacuum for picking up a ball. There is an inquiry in block 258 saying has a ball arrived at $S_9$ yet. If the answer is yes there is an output delay for the ball to be gripped by the orienter 33 by signaling the down counting clock, block 259. If there is not, there is a repetition of the inquiry until there is a ball at $S_9$. The time is checked in blocks 260 and 261 to allow the vacuum in the orienter to grip the ball firmly. Thereafter, the computer outputs "retract orienter, in block 262, FIG. 35. This effects retraction of the orienter 33. There is a loop, until the orienter retracts, by the computer which inquires if a ball is as $S_{11}$ in block 263. When the answer is finally yes, the orientation cycle counter is set to zero in block 264 to count the cycles through the orientation. Thereafter, the computer enters into circle G, 265. The computer starts the orienter motor clockwise in block 266. In block 268, the computer inquires if $S_{10}$ has seen a ball seam. If the answer is no there is repeat in the loop until the sensor $S_{10}$ recognizes a seam. If the answer is yes the store of the value of $E_{01}$ at the first seam and proceed to again ask if $S_{10}$ recognizes a second seam in block 271. When the second seam is recognized, the value of $E_{02}$ is stored in block 272. Thereafter, the computer outputs to reverse the direction of the orienter motor to counter clockwise (CCW) in block 273. There is a computer computation of half the distance between $E_{01}$ and $E_{02}$ to compute the $E_{0A}$ position the orienter motor is to go to. Thereafter, the value $E_{0A}$ is compared with the input $E_0$ in block 276 and 277. Once they are the same, the output signal is stopped and the sensor $S_{10}$ is oriented halfway between the two seams sensed. It is to be recognized that these seams could be close together or far apart at this point. Thereafter, there is an output to turn on the vacuum to the loader, followed by an output to turn off the vacuum to the orienter. There is, in block 281, FIG. 37, an output delay for the vacuum to collapse in the orienter by counting the delay into the down counting clock. In block 282–284 the time is checked to see if the time has been sufficent for the ball to have been released by the orienter and the ball to be picked up by the vacuum in the loader. After sufficent time, the computer outputs in block 284 to rotate the loader motor clockwise (CW). Again the computer repeats the process for the loader the process hereinbefore described for the orienter; namely, rotating the ball until the sensor sees two seams and then backing up half the distance between the location of the two seams; per blocks 284–296. The computer then increments the orientation cycle counter in block 297. In block 298, the computer asks if the cycle count is equal to 3. If not, the orientation process is not yet complete and the no route 359 is entered. Specifically, there is an output in block 299, to turn on vacuum to the orienter. An output is given in block 300 to turn off loader vacuum. There is an output delay for the vacuum to collapse in the loader. Counting in the down counting blocks 301–303 allows time for the vacuum to collapse in the loader and to build up in the orienter. The computer then inquires in block 304 if there is a ball at $S_{11}$ still. If there is not, this is a signal that the ball is missing and the computer is in an abort mode. The computer then fetches another ball by going to F, in circle 232. The sensor $S_{11}$ can be queried as often as desired; for example as soon as each motion is performed that would conceivably cause a failure of the ball to be where it should be.

If the answer is yes, the ball is where it should be and the computer goes to circle G, 305 to repeat the orientation routine.

Figure 38:
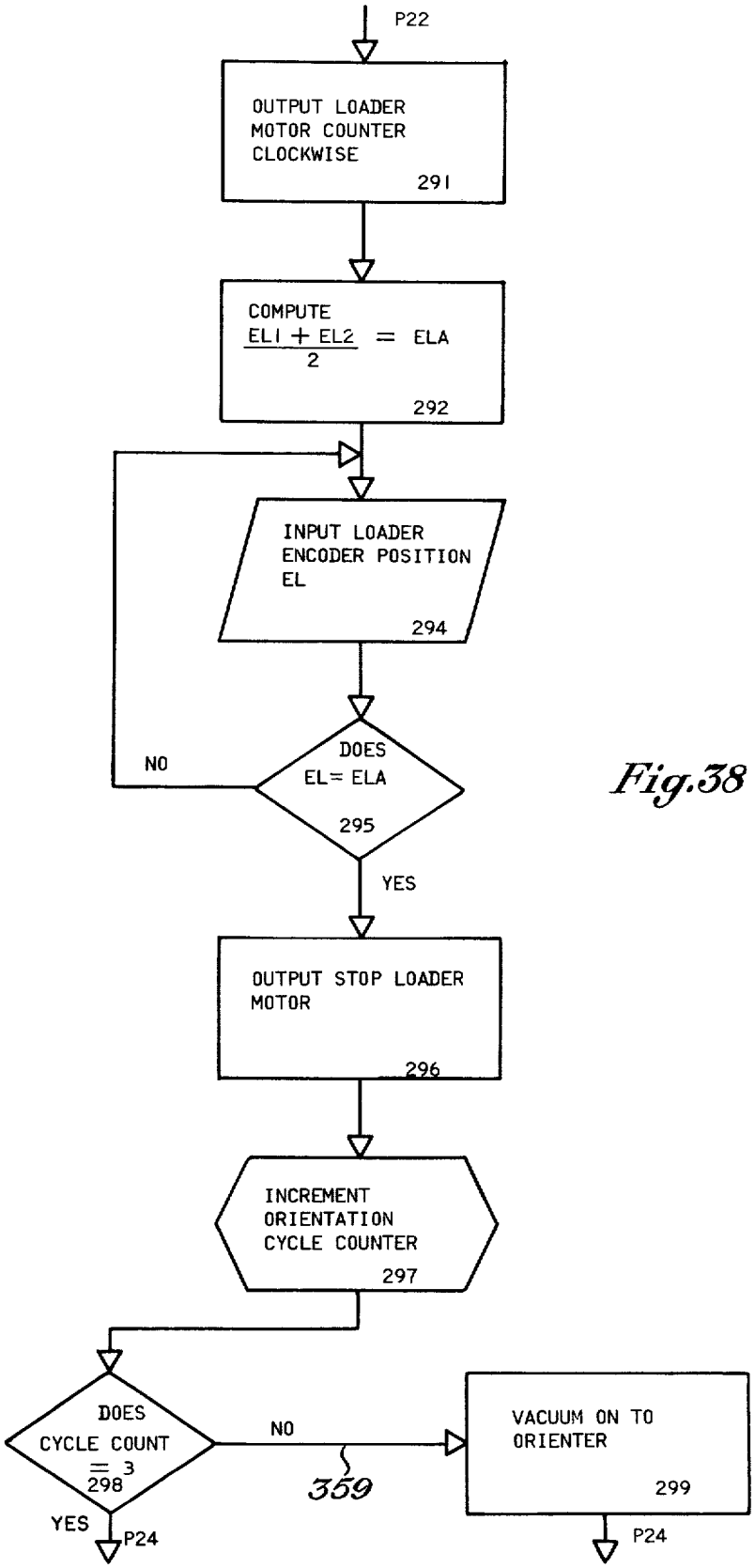
Figure 39:
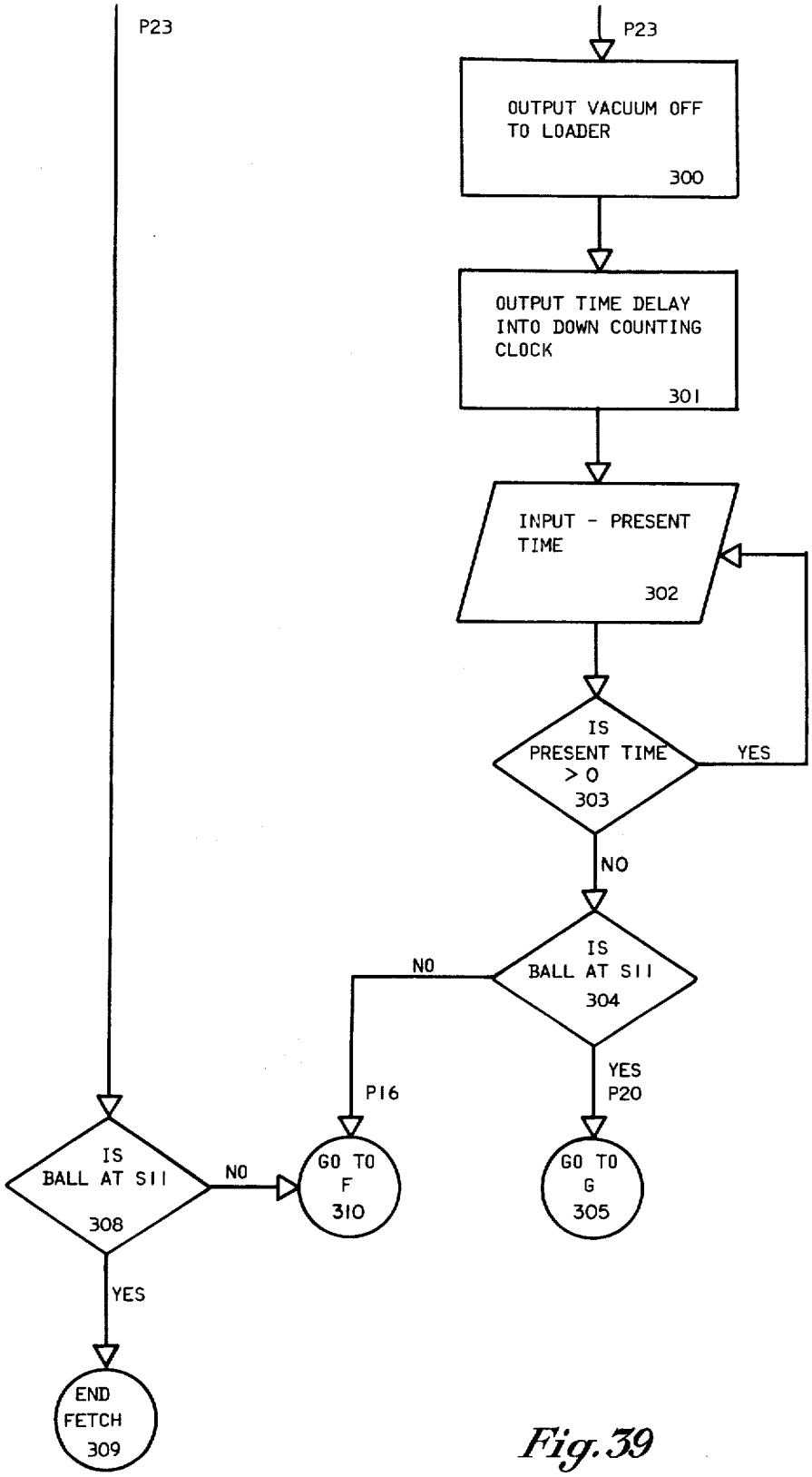

Once the cycle count equals 3, as shown in block 298, the orientation process is complete and the yes route FIG. 38, FIG. 39, is entered. Again an inquiry is made of the sensor $S_{11}$ to see if the ball is there. If the ball exists at $S_{11}$, it is oriented in the loader ready for loading. The fetch subroutine is ended in circle 309. The loader is ready to extend the ball into the rotating wheels 15 as discussed earlier in the program. If the answer is no, the computer goes to F as shown by circle 310 to obtain another ball since some condition has caused an abort of the first ball.

In effect, the respective pitch characteristics are input for each pitch; singly, or from a storage, or memory apparatus such as cartridge, cassette or the like. The computer makes the respective caculations and sets respective motors to effect the desired position of the rifle angles, rotation speed of the wheels, the altitude, azimuth, height and width and then orients the ball and causes it to be fed to the rotating wheels. The ball is then thrown in the manner described. This throwing may be a pitching, per se, at a batter or the like to give the batter practice at various speeds and curves of the ball. On the other hand, the ball may be thrown to simulate a hitting situation as by a batter batting flies to the field. In like manner, grounders may be hit to the infield to give practice to the infielders.

Figure 11:
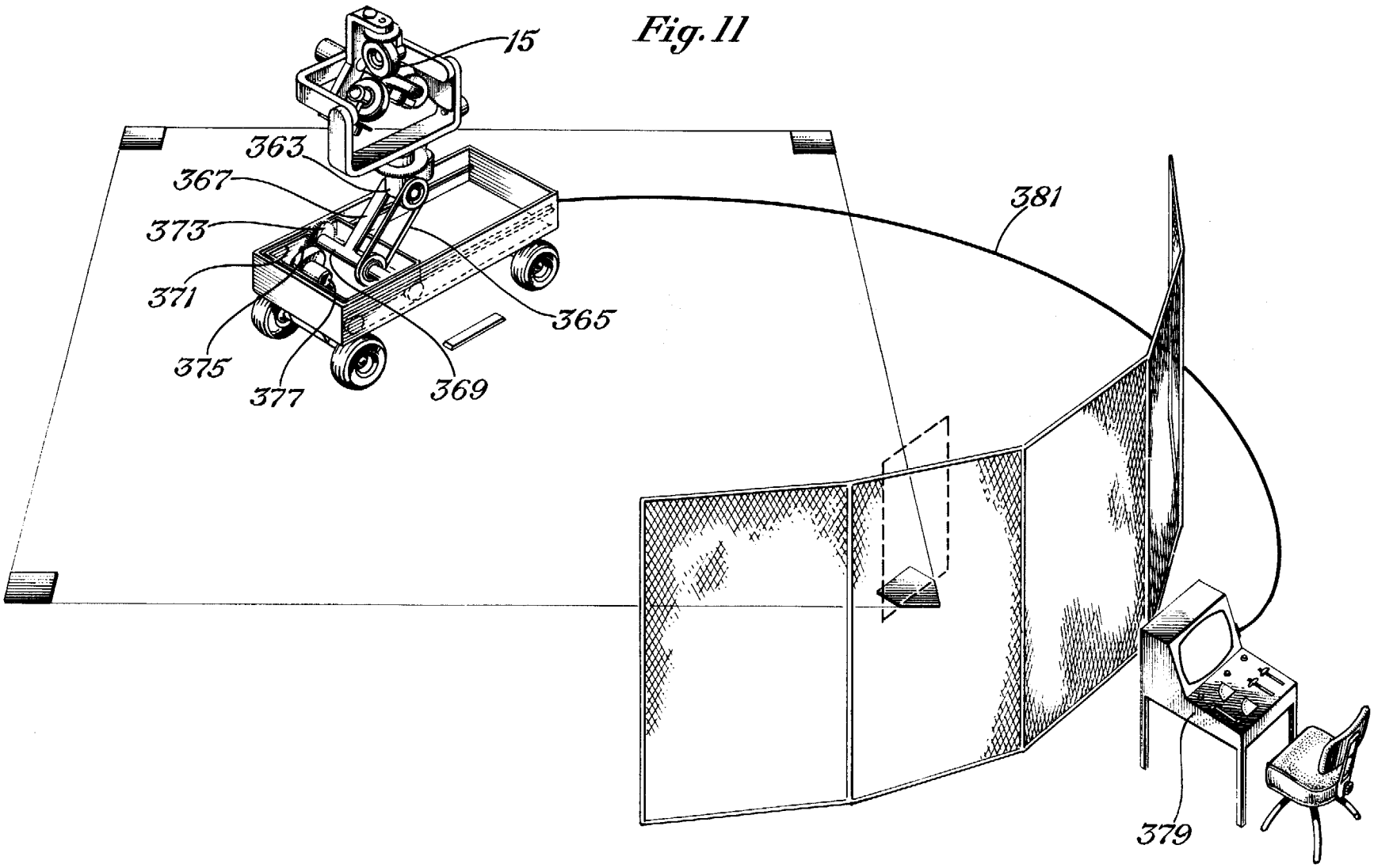
FIG. 11 is an isometric view, partly schematic, of another embodiment of this invention.

Another embodiment of this invention is illustrated in FIG. 11. Therein, the respective three rotating wheels 15, ball feeding means and the like are mounted on a main central support 363 that is maintained in its same vertical orientation by belts 365. Main structural supporting member 367 is fixedly mounted to a horizontal pivot 369. The horizontal pivot 369 is pivotally carried by carriage frame 371. The internal carriage 370 may also be moveable laterally to avoid having to move the entire trailer mounted machine. The horizontal pivot 369 may be pivoted to a desired position, heightwise and widthwise, by any suitable means; such as hydraulic rams, gear and pinion or the like. As illustrated a circular gear 373 is fixedly connected with horizontal pivot 369. Pinion 375 engages the gear 373 and is powered by reversible motor 377. A remote console 379 is connected via conductors in cable 381 to enable an operator, such as a coach, to control the pitching machine as described hereinbefore.

In operation, the apparatus of FIG. 11 is similar to that of FIG. 1, except that the wheels and ball feed point are moved in an arc by the pivoting of supporting member 367.

While specific embodiments of this invention has been described in detail, it must be remembered that there are a wide variety of different approaches that can be employed operationally depending upon the costs that are justified by the situtation. For example, empirical settings may be tried and the resultant data stored such that the settings can be set into trial and error charts given to a simple computer for a discrete number of specific pitches, rather than having relatively complicated mathematical algorithms solved by the computer. This sort of empirical data represent a compromise between the manual operation of the apparatus, the semiautomatic operation of the apparatus, and the fully computerized operation described hereinbefore. Of course, there are a wide variety of different mathematical algorithms that empirically describe the flight of the ball. Any of these mathematical algorithms may be programmed into the computer by a programmer such that they can be employed instead of the equations given.

It is to be borne, in mind, also, that there are many structures that can be employed to give usable results, even though the results may be inferior, or the apparatus may be more complex or otherwise inferior; for example, by revolving around other than center line of rotation of rifle angles. In fact, early embodiments of the invention employed screws to set the respective angles, altitude, azimuth, height and pitching widths on the machine, instead of pinions and gears with motors to effect the desired position as described herein.

The complexity of the models and embodiments employed will depend upon the economics of the respective situtation. For example, where mobile machines are to be employed in amusement parks or the like, it may be desirable to economize and deliberately sacrifice the input of variables such as barometric pressure, temperature and the like rather than supplying them into the computer and having it solve more complicated equations. On the other hand, where a baseball club or the like may employ only a single piece of apparatus and computer, it may employ more elaborate and more expensive models.

Although the invention has been described with a certain degree of particularity, it is understood that the present disclosure is made only by way of example and the numerous changes and details of construction and combination of arrangements of parts, computer programmes, sub routines and the like may be resorted to without departing from the spirit and scope of the invention; reference being had for the latter purpose to the appended claims.

What is claimed is:

1. A ball pitching machine comprising:

a. ball feeding means for feeding respective balls to a feeding point where they will be acted upon by rotating wheel;

b. a plurality of at least three rotatable wheels; said wheels having planes and centers of rotation; said centers of rotation being substantially co-planar and disposed at spaced apart locations in said plane, said wheels and their respective planes of rotation being disposed about said feeding point closely enough to act upon a fed ball and adapted to be oriented at a plurality of individual rifle angles independently of each to effect selectively a plurality of respective spin vectors with respect to a normal trajectory axis equivalent to a straight line of flight of said ball; said wheels having respective location lines from said feeding point to their respective centers of rotation; said location lines being at respective predetermined angles with respect to adjacent said location lines and being disposed so as to define a unique feeding point for said ball and contact said ball on at least three peripheral points;

c. rotation means for rotating respective said wheels at a plurality of individual respective rotational speeds for acting on a fed said ball and effecting a type of spin on the pitched ball, and d. rifle angle means for orienting each of said wheels independent of the other wheels at a plurality of respective individual said rifle angles with respect to said normal trajectory axis and effecting a rifle spin on said pitched ball;

whereby said ball can be pitched with a spin of about any predetermined axis through a combination of said rotation means and said respective rifle angle means.

2. The machine of claim 1 wherein said pitching machine includes a main azimuth means for effecting a plurality of predetermined trajectories at a plurality of azimuths in a horizontal plane.

3. The machine of claim 1 wherein said pitching machine includes a main altitude means for effecting a plurality of predetermined trajectories at a plurality of altitude trajectories.

4. The machine of claim 1 wherein said pitching machine includes a translating means for effecting a plurality of predetermined lateral positions for said feeding points for simulating right hand delivery and left hand delivery.

5. The machine of claim 1 wherein said pitching machine included a lifting means for effecting a plurality of predetermined vertical positions for said feeding points for simulating kinds of pitching delivery heights.

6. The machine of claim 1 wherein said pitching machine includes:

a. a main azimuth means for effecting a plurality of predetermined trajectories at a plurality of azimuths in a horizontal plane;

b. a main altitude means for effecting a plurality of predetermined trajectories at a plurality of altitudes in a vertical plane;

c. a translating means for effecting a plurality of predetermined lateral positions for said feeding point for simulating right hand delivery and left hand delivery; and d. lifting means for effecting a plurality of predetermined vertical positions for said feeding points for simulating kinds of pitching delivery.

7. The machine of claim 1 wherein said ball feeding means includes at least one reciprocally movable, loader spindle that is operable to grip a ball and move it to feed said ball to spinning said wheels at said feeding point for pitching operation.

8. The machine of claim 7 wherein said spindle comprises a tubular cylinder for gripping said ball when vacuum is connected thereto.

9. The machine of claim 7 wherein there is provided an orienting spindle disposed at a predetermined angle with respect to said loading spindle; said orienting spindle being reciprocally moveable so as to take said ball from said loading spindle for rotating it to effect a predetermined orientation of the seams of the ball for each pitch.

10. The machine of claim 9 wherein said orienting spindle is reciprocally movable to pick up a ball at said pick up point and deliver it opposite the entrance to said feeding spindle.

11. The machine of claim 1 wherein said center of rotation of said wheels are adjustable to a plurality of distances from said feeding ponts so as to be able to be set to fit any one of a plurality of balls of different sizes.

12. The machine of claim 1 wherein said three wheels are equally spaced throughout the 360° in the plane of their centers of rotation.

13. The machine of claim 12 wherein one of said wheels is disposed in one of the vertical and horizontal planes.

14. The machine of claim 1 wherein a speed means is provided for attaining a predetermined speed on each of said wheels.

15. The machine of claim 1 wherein a shield is provided for protecting said ball pitching machine against batted balls, said shield being moveable, at times covering said trajectory axis and at the other times removed from covering said trajectory axis.

16. Apparatus for throwing the ball in a predetermined type of pitch comprising:

a. a ball pitching machine comprising:

i. a ball feeding means for feeding respectively balls to a feeding point where they will be acted upon by rotating wheels;

ii. a plurality of at least three rotatable wheels; said wheels having planes and centers of rotation; said centers of rotation being substantially coplanar and disposed at spaced apart locations in said plane, said wheels and their respective planes of rotation being disposed about said feeding point closely enough to act on a fed ball and adaptable to be oriented at a plurality of individual rifle angles independently of each to effect selectively a plurality of respective spin vectors with respect to an initial normal trajectory axis equivalent to a straight line of flight of said ball; said wheels having respective location lines from said feeding point to their respective centers of rotation; said location lines being at respected predetermined angles with respect to adjacent said location lines and being disposed so as to define a unique feeding point for said ball and contact said ball on at least peripheral points;

iii. rotation means for rotating respective said wheels at a respective plurality of respective individual rotational speeds for acting on a fed said ball and effecting a type of pitched ball with respect to a type curve; and iv. rifle angle means for orienting each of said wheels independent off the other wheels at a plurality of individual and respective said rifle angles with respect to said normal trajectory axis and effecting a spin at any angle with respect to velocity on said pitched ball;

b. input means for inputting at least one of the set of values of the variables that determine impact point and the values of the variables that determine a type of pitch for effecting a predetermined pitch;

c. a computer means for computing at least respective speeds of rotation of respective said wheels and rifle angles for orientation of said wheels; said computer means being connected with said input means for receiving the input variables;

d. speed control means for bringing respective wheels to their respective speeds as computed by said computer means; said speed control means being connected with said computer and with said rotation means so as to determine the magnitude of speed and when said speed for each said wheel reaches its said computed speed;

e. rifle angle control means for bringing respective said wheels to their respective rifle angles as computed by said computer means; said rifle angle control means being connected with said computer and with said rifle angle means so as to determine the magnitude of the rifle angle and when said rifle angle for each said wheel reaches its said computed rifle angle position; and f. means for energizing said ball feeding means when said speed and said rifle angles have been attained.

17. The apparatus of 16 wherein said computer predetermines trajectory and impact point and can output said impact point and trajectory to a display in addition to controlling the pitching machine.

18. The apparatus of claim 16 wherein said ball pitching machine includes a main azimuth means for effecting a plurality of predetermined trajectories at a plurality of azimuths in a horizontal plane; said computer means computes the azimuthal trajectory initially to be given said ball; and there is provided an azimuth control means for bringing the azimuth to said azimuthal trajectory computed by said computer means.

19. The apparatus of claim 16 wherein said ball pitching machine includes a main altitude means for effecting a plurality of predetermined trajectories at a plurality of altitude trajectories in a vertical plane; said computer means computes the altitude trajectory initial to be given said ball; and there is provided an altitude control means for bringing the altitude to said altitude trajectory computed by said computer means.

20. The apparatus of claim 16 wherein said ball pitching machine includes a translating means for effecting a plurality of predetermined lateral positions for said feeding points for simulating right hand delivery and left hand delivery; said computer computes the lateral position from which said ball is to be initially delivered; and there is provided a translating control means for bringing the lateral position to the lateral position computed by said computer means.

21. The apparatus to claim 16 wherein said ball pitching machine includes a lifting means for effecting a plurality of predetermined vertical positions for said feeding points for simulating kinds of pitching delivery; said computer means computes the vertical position for said feeding point for said ball; and there is provided a lifting control means for bringing the feeding point to the vertical feeding point computed by said computer means.

22. The apparatus of claim 16 wherein said pitching machine includes a main azimuth means for effecting a plurality of predetermined trajectories at a plurality of azimuths in a horizontal plane; said computer means computes the azimuthal trajectory initially to be given said ball; and there is provided an azimuth control means for bringing the azimuth to said azimuthal trajectory computed by said computer means;

a main altitude means for effecting a plurality of predetermined trajectories at a plurality of altitude trajectories; said computer means computes the altitude trajectory initially to be given said ball; and there is provided an altitude control means for bringing the altitude to said altitude trajectory computed by said computer means;

a translating means for effecting a plurality of predetermined lateral positions for said feeding points for simulating right hand delivery and left hand delivery; said computer computes the lateral position from which said ball is to be initially delivered; and there is provided a translating control means for bringing the lateral position to the lateral position computed by said computer means;

a lifting means for effecting a plurality of predetermined vertical positions for said feeding points for simulating kinds of pitching delivery; said computer means computes the vertical position for said feeding point for said ball; and there is provided a lifting control means for bringing the feeding point to the vertical feeding point computed by said computer means.

23. The apparatus of claim 22 wherein said input means inputs variables for effecting both a predetermined pitch and an impact point; said computer means computes and sets respective said means for said pitch and said impact point.

24. The apparatus of claim 16 wherein said ball feeding means includes a reciprocally movable loading spindle that is operable to grip said ball and move it to feed said ball to the spinning said wheels at said feeding point for the pitching operation; an orienting spindle disposed at a predetermined angle with respect to said loading spindle; said orienting spindle being reciprocally movable so as to take a said ball from said loading spindle for rotating it to effect a predetermined orientation before the ball is fed for its respective pitch; said orienting spindle being reciprocally movable to pick up a ball at a pick up point and deliver it opposite the entrance to said loading spindle; a sensor for determining when seams on said ball are rotated into proximity thereto; respective spindle rotation means for independently rotating said orienting spindle and said loading spindle; rotation control means connected with said computer for rotating respective said spindles responsive to said computer; orientation subroutine in said computer for effecting a predetermined orientation of said ball before it is fed to said ball pitching machine.

25. The apparatus of claim 24 wherein said loading spindle translation speed control means is connected with said computer means said loading spindle for effecting a predetermined loading speed of said ball.

26. The apparatus of claim 16 wherein a calibration subroutine is provided in said computer for correcting for variation from standard of respective variables at a given time, atmospheric pressure, rotational speed, air temperature, tire size, coefficient of friction, ball size, ball weight, ball aerodynamic coefficients, machine position coordinates, wind velocity, and wind direction.

27. The apparatus of claim 26 wherein respective sensors are provided for monitoring:

a. air temperature
b. relative humidity
c. barometric pressure
d. wind velocity
e. wind direction.

28. The apparatus of claim 26 wherein said input means includes a programmable input for inputting sequentially a plurality of sets of variables for respective pitches.

29. The apparatus of claim 28 wherein said input means includes an operator control that allows said operator to choose a respective pitch to be input to said computer before each respective pitch.

30. The apparatus of claim 29 wherein said operator control is remotely operable to control said computer from a spaced apart location.

31. The apparatus of claim 28 wherein said input means includes a prerecorded set of pitches to be input to the computer as from a cassette tape, eprom, or bubble memory.

32. The apparatus of claim 26 wherein said input means employs two respective shaft encoders 207 and 209 connected with an orientable ball knob 211 and holder 213 such that the ball knob 211 can be rotated to a setting on the shaft encoder 207 to get the desired spin direction vector around the indicated horizontal axis through the ball and the holder 213 can be rotated to obtain the setting on the shaft encoder 209 to get the spin direction vector with respect to the vertical axis through the ball and the range $X_t$, target $Y_t$, and $Z_t$ and pitches $Y_s$ and $Z_s$ are input with digital designators intelligible to said computer means.

33. The apparatus of claim 16 wherein a shield is provided for protecting said ball pitching machine against batted balls; said shield is openable and closeable; a shield operating means is connected with said shield and with said computer so as to open said shield immediately before a said ball is pitched and close said shield before said ball reaches its impact point.

* * * * *